US012702260B2

(12) United States Patent
Knapp et al.

(10) Patent No.: US 12,702,260 B2
(45) Date of Patent: Aug. 11, 2026

(54) SURFACE CLEANING APPARATUS

(71) Applicant: BISSELL Inc., Grand Rapids, MI (US)

(72) Inventors: Mackenzie Leigh Knapp, Saranac, MI (US); Brian Robert Dexter, Grand Rapids, MI (US); Tyler Newkirk, Grand Rapids, MI (US); Churu Yun, Plainwell, MI (US); Connor Canavan, Kalamazoo, MI (US); Nicholas Harvey Jobbitt, Kalamazoo, MI (US)

(73) Assignee: BISSELL Inc., Grand Rapids, MI (US)

( * ) Notice: Subject to any disclaimer, the term of this patent is extended or adjusted under 35 U.S.C. 154(b) by 142 days.

(21) Appl. No.: 18/080,805

(22) Filed: Dec. 14, 2022

(65) Prior Publication Data

US 2023/0190063 A1 Jun. 22, 2023

Related U.S. Application Data

(60) Provisional application No. 63/291,675, filed on Dec. 20, 2021.

(51) Int. Cl.
*A47L 9/32* (2006.01)
*A47L 7/00* (2006.01)
(Continued)

(52) U.S. Cl.
CPC ..... *A47L 9/325* (2013.01); *A47L 7/0023* (2013.01); *A47L 9/009* (2013.01); *A47L 9/242* (2013.01); *A47L 9/248* (2013.01)

(58) Field of Classification Search
CPC ..... A47L 9/009; A47L 9/0009; A47L 9/0054; A47L 9/0063; A47L 9/22; A47L 9/24;
(Continued)

(56) References Cited

U.S. PATENT DOCUMENTS 2,271,536 A * 2/1942 Berg ..... A47L 9/325 15/DIG. 10
4,513,469 A 4/1985 Godfrey et al.
(Continued)

FOREIGN PATENT DOCUMENTS

CN 108309149 A1 7/2018
CN 209404646 U 9/2019
(Continued)

OTHER PUBLICATIONS

WO2019026309 PE2E Translation; Electric Vacuum Cleaner; Inoue, Teruhisa; Feb. 7, 2019 (Year: 2019).*
(Continued)

*Primary Examiner* — Brian D Keller
*Assistant Examiner* — Sidney D Full
(74) *Attorney, Agent, or Firm* — McGarry Bair PC

(57) ABSTRACT

A surface cleaning apparatus includes a base assembly with a suction nozzle and at least one wheel. A hand-held portion has a hand grip, a recovery container, and a suction source in fluid communication with the suction nozzle and the recovery container and configured for generating a working airstream. A wand is operably coupled between the base assembly and the hand-held portion and defines at least a portion of a working air path extending from the suction nozzle to an air outlet in the hand-held portion and including the suction source.

17 Claims, 24 Drawing Sheets

(51) Int. Cl.
*A47L 9/00* (2006.01)
*A47L 9/24* (2006.01)

(58) Field of Classification Search
CPC ..... A47L 9/242; A47L 9/248; A47L 9/325; A47L 9/0018; A47L 9/32; A47L 9/322; A47L 13/24; A47L 13/25; A47L 13/254; A47L 13/26; Y10T 24/44641
USPC .... 15/230.11, 244.2, 143.1, 144.1, 22.1, 410
See application file for complete search history.

(56) References Cited

U.S. PATENT DOCUMENTS

| | | | | |
|---|---|---|---|---|
| 4,893,368 | A | 1/1990 | Ward | |
| 8,151,411 | B2 | 4/2012 | Beskow et al. | |
| 8,281,456 | B2 | 10/2012 | Finke | |
| 8,769,764 | B2 | 7/2014 | Crouch et al. | |
| 8,966,708 | B2 | 3/2015 | Worker et al. | |
| 8,991,005 | B2 | 3/2015 | Mersmann | |
| 9,516,979 | B2 | 12/2016 | Gidwell | |
| 9,622,630 | B2 | 4/2017 | Faremo et al. | |
| 10,849,474 | B2 | 12/2020 | Hwang et al. | |
| 11,529,033 | B2 * | 12/2022 | Conrad | A47L 9/149 |
| 12,053,140 | B2 * | 8/2024 | Thorne | A47L 9/0054 |
| 2004/0250375 | A1 | 12/2004 | Chen | |
| 2006/0156509 | A1 * | 7/2006 | Luebbering | A47L 9/0009 15/410 |
| 2008/0040883 | A1 * | 2/2008 | Beskow | A47L 9/20 15/329 |
| 2008/0189901 | A1 * | 8/2008 | Jansen | A47L 9/06 15/331 |
| 2016/0058253 | A1 | 3/2016 | Kim et al. | |
| 2016/0157690 | A1 * | 6/2016 | Streciwilk | A47L 5/32 15/331 |
| 2017/0303754 | A1 | 10/2017 | Conrad et al. | |
| 2022/0117455 | A1 | 4/2022 | King | |

FOREIGN PATENT DOCUMENTS

| | | | | | |
|---|---|---|---|---|---|
| DE | 102014119186 | A1 * | 6/2016 | | |
| FR | 2677599 | A1 | 12/1992 | | |
| JP | 2003265383 | A * | 9/2003 | | |
| JP | 2005137553 | A | 6/2005 | | |
| JP | 2009195358 | A * | 9/2009 | | |
| JP | 2017000196 | A | 1/2017 | | |
| JP | 2017159023 | A | 9/2017 | | |
| KR | 20160128111 | A * | 11/2016 | | A47L 5/28 |
| WO | 2017186280 | A1 | 11/2017 | | |
| WO | WO-2019026309 | A1 * | 2/2019 | | A47L 9/28 |
| WO | 2020192334 | A1 | 10/2020 | | |

OTHER PUBLICATIONS

WIPO Translation WO2020192334; Vacuum Cleaner Suction Nozzle and Vacuum Cleaner; Jinsong, Peng; Oct. 1, 2020 (Year: 2020).*
WIPO Translation DE102014119186; Cleaning Device With Storage Aid ; Jun. 23, 2016 (Year: 2016).*
KR-20160128111 Espacenet Translation; Handy Type Cleaner; Cho Yeon Woo; Nov. 7, 2016 (Year: 2016).*
JP-2003265383 Espacenet Translation; Vacuum Cleaner; Suzuki Hitoshi; Sep. 24, 2003 (Year: 2003).*
JP-2009195358 Espacenet Translation; Vacuum Cleaner; Kodachi Toru; Sep. 3, 2009 (Year: 2009).*
CN 108309149 Espacenet Translation; Tool for Dust Collector and Dust Collector Thereof; Wei, Ying-Iong; Jul. 24, 2018 (Year: 2018).*
European Patent Office, Extended European Search Report re Corresponding Application No. 22211554.5-1016, May 31, 2023, 6 pages, Munich, Germany.

* cited by examiner

SURFACE CLEANING APPARATUS

CROSS REFERENCE TO RELATED APPLICATION(S)

This application claims the benefit of U.S. Provisional Patent Application No. 63/291,675, filed Dec. 20, 2021, which is incorporated herein by reference in its entirety.

BACKGROUND

Surface cleaning apparatuses such as vacuum cleaners are well-known devices for removing dirt and debris from a variety of surfaces such as carpets, hard floors, or other fabric surfaces such as upholstery. Such surface cleaning apparatuses typically include a recovery system including a recovery container, a nozzle adjacent the surface to be cleaned and in fluid communication with the recovery container through a conduit, and a source of suction in fluid communication with the conduit to draw debris-laden air from the surface to be cleaned and through the nozzle and the conduit to the recovery container.

BRIEF DESCRIPTION

In one aspect, the disclosure relates to a surface cleaning apparatus, comprising a base assembly including a suction nozzle and at least one wheel, a hand-held portion having a hand grip, a recovery container, and a suction source in fluid communication with the suction nozzle and the recovery container and configured for generating a working airstream, a wand operably coupled between the base assembly and the hand-held portion and defining at least a portion of a working air path extending from the suction nozzle to an air outlet in the hand-held portion and including the suction source, and a gripping assembly moveably mounted to the hand-held portion and moveable between a first position and a second position wherein at least a portion of the gripping assembly is configured to engage a surface or object against which the surface cleaning apparatus is leaned.

In another aspect, the disclosure relates to a surface cleaning apparatus, comprising a base assembly including a suction nozzle and at least one wheel, a hand-held portion having a hand grip, a recovery container, and a suction source in fluid communication with the suction nozzle and the recovery container and configured for generating a working airstream, a wand operably coupled between the base assembly and the hand-held portion and defining at least a portion of a working air path extending from the suction nozzle to an air outlet in the hand-held portion and including the suction source, and a brake assembly pivotally mounted to the base assembly and configured to be moveable between a first locked position wherein at least a portion of the brake assembly engages the at least one wheel and is configured to prevent rotation of the at least one wheel and the wand is prevented from lateral movement relative to the base assembly and a second unlocked position.

DETAILED DESCRIPTION

The disclosure relates to a surface cleaning apparatus such as a hand-held surface cleaner. Such hand-held cleaners can be in the form of a stick vacuum or wand vacuum. The surface cleaning apparatus can also include a base assembly including an agitator chamber. It will be understood that a variety of surface cleaning apparatus exist including those which are top heavy and additionally or alternatively include wheeled bases or bases including rotating portions. In either scenario, when an upper portion of the surface cleaning is leaned against a wall or other object, a lower portion may tend to move from the placed location. In certain circumstances this can cause the surface cleaning apparatus to tilt, fall, or otherwise cause dissatisfaction to a user.

A brake assembly can be provided on the base assembly and be configured to be moveable between at least a first position and a second position. When the brake assembly is in the first position, at least a portion of the brake assembly can restrain movement of the base of the surface cleaning apparatus. In one non-limiting example, the brake assembly can contact and restrain a set of wheels of the base assembly to prevent them from rotating.

Alternatively, or in addition to the inclusion of the brake assembly, the surface cleaning apparatus can include a variety of other structures or features to aid in maintaining the surface cleaning apparatus in an upright or semi-upright position, which can be thought of as a storage position, when the surface cleaning apparatus, or at least a lower portion thereof, is not in use. These various structures can serve to maintain the surface cleaning apparatus in a variety of storage positions, non-limiting examples of which can include being leaned against a wall or other object, being hung from a surface or other object, or being provided in a self-sustaining stand-alone configuration.

Figure 1:
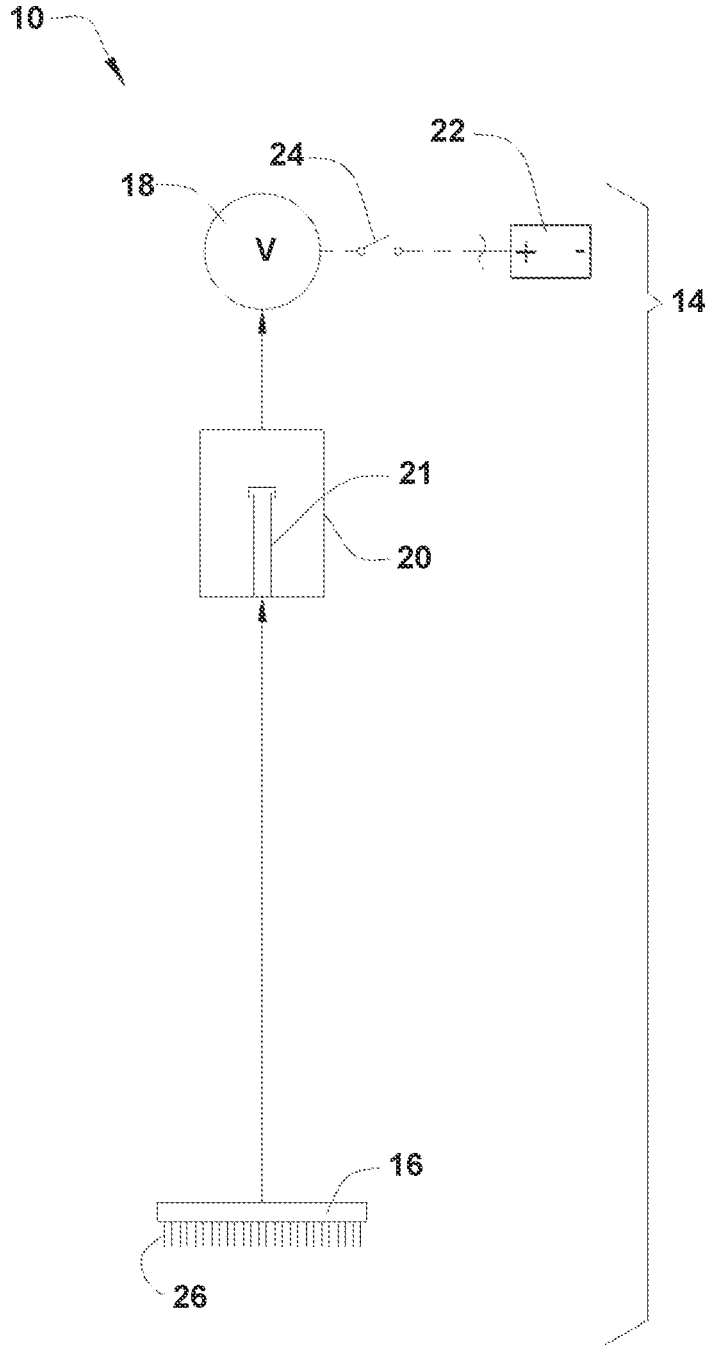
FIG. 1 is a schematic view of a surface cleaning apparatus according to various aspects described herein.

FIG. 1 is a schematic view of various functional systems of a surface cleaning apparatus in the form of an exemplary vacuum cleaner 10. The functional systems of the exemplary vacuum cleaner 10 can be arranged into any desired configuration including as a portable cleaner adapted to be hand carried by a user for cleaning relatively small areas. The vacuum cleaner 10 can be adapted to include a hose or other conduit, which can form a portion of the working air path between a nozzle and the suction source.

The vacuum cleaner 10 can include a recovery system 14 for removing debris from the surface to be cleaned and storing the debris. The recovery system 14 can include a suction inlet or suction nozzle 16, a suction source 18 in fluid communication with the suction nozzle 16 for generating a working air stream, and a recovery container 20 for separating and collecting debris from the working airstream for later disposal.

The suction nozzle 16 can be provided on a base or cleaning head adapted to move over the surface to be cleaned. At least one agitator 26 can be provided adjacent to the suction nozzle 16 for agitating the surface to be cleaned so that the debris can be more easily ingested into the suction nozzle 16. Some examples of agitators 26 include, but are not limited to, a horizontally-rotating brushroll, dual horizontally-rotating brushrolls, one or more vertically-rotating brushrolls, or a stationary brush. The at least one agitator 26 can also be configured to cling to or otherwise retain dirt or debris removed from the surface to be cleaned, such as a disposable cleaning pad, wherein such retained dirt or debris is not ingested into the suction nozzle 16.

The suction source 18 can be any suitable suction source and is provided in fluid communication with the recovery container 20. The suction source 18 can be electrically coupled to a power source 22, such as a battery or by a power cord plugged into a household electrical outlet. A suction power switch 24 between the suction source 18 and the power source 22 can be selectively closed by the user, thereby activating the suction source 18.

A separator 21 can be formed in a portion of the recovery container 20 for separating entrained debris from the working airstream.

The vacuum cleaner 10 shown in FIG. 1 can be used to effectively remove debris from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps.

In operation, the vacuum cleaner 10 is prepared for use by coupling the vacuum cleaner 10 to the power source 22. During operation of the recovery system 14, the vacuum cleaner 10 draws in debris-laden working air through the suction nozzle 16 and into the downstream recovery container 20 where the debris is substantially separated from the working air and deposited in the recovery container. The airstream then passes through the suction source 18 prior to being exhausted from the vacuum cleaner 10. The recovery container 20 can be periodically emptied of collected fluid and debris.

While not illustrated it will be understood that the surface cleaning apparatus including the vacuum cleaner 10 can include a fluid delivery system for storing cleaning fluid and delivering the cleaning fluid to the surface to be cleaned. The fluid delivery system can include a fluid supply container for storing cleaning fluid, as well as at least one fluid distributor fluidly coupled to the fluid supply container.

Figure 2:
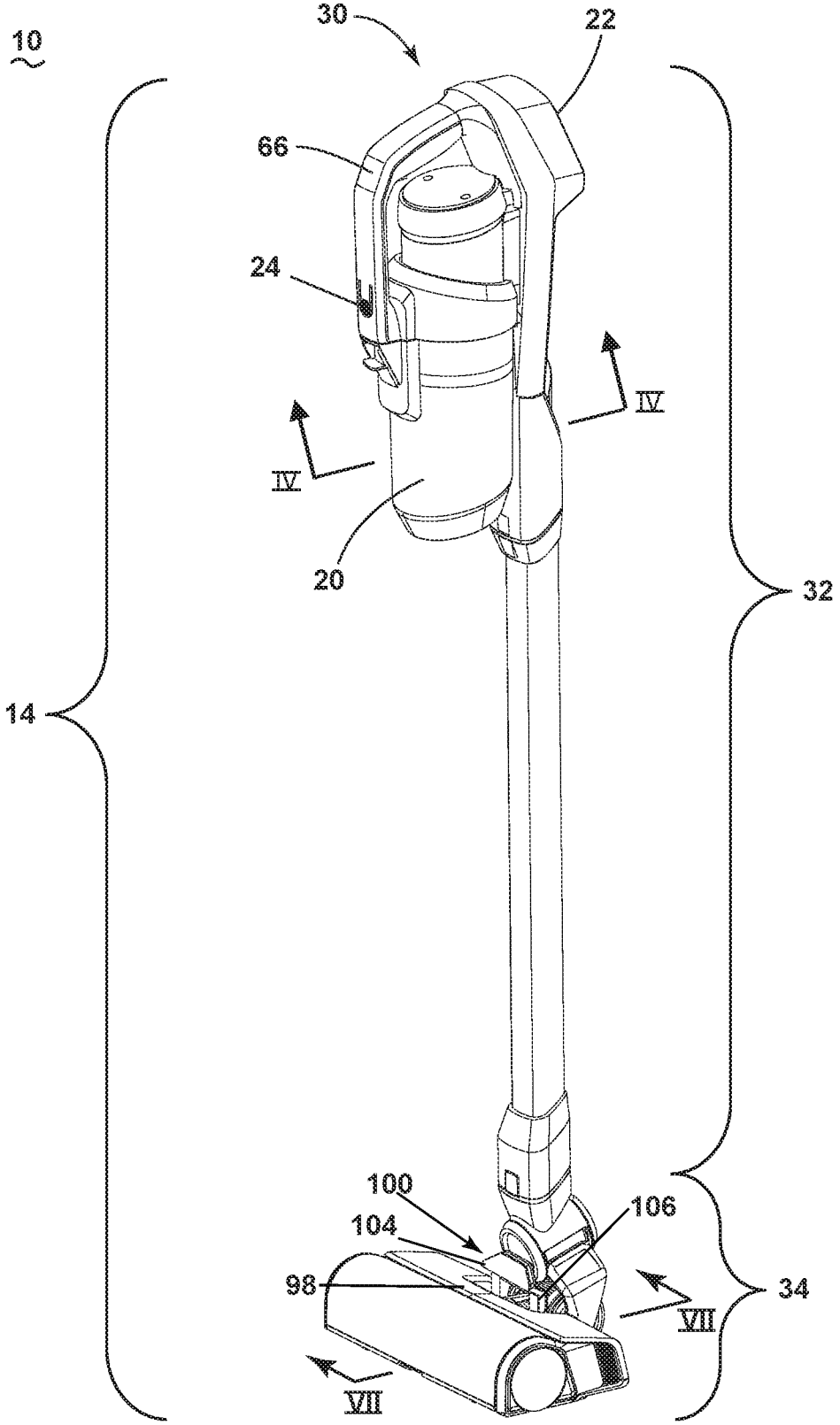
FIG. 2 is a perspective view of the surface cleaning apparatus of FIG. 1 in the form of a hand-held vacuum cleaner including a base assembly and an upright assembly according to various aspects described herein.

FIG. 2 is a perspective view illustrating a vacuum cleaner 10 according to various aspects described herein. For purposes of description related to the figures, the terms "upper," "lower," "right," "left," "rear," "front," "vertical," "horizontal," "inner," "outer," and derivatives thereof shall be described from the perspective of a user behind the vacuum cleaner 10, which defines the rear of the vacuum cleaner 10. However, it is to be understood that the disclosure may assume various alternative orientations, except where expressly specified to the contrary.

In the illustrated example, the vacuum cleaner 10 can include a housing 30 with an upright assembly 32 and a base assembly 34. The upright assembly 32 can be operably coupled to the base assembly 34 for directing the base assembly 34 across the surface to be cleaned. A joint or other pivoting mechanism can be utilized to pivotally connect the upright assembly 32 to the base assembly 34. It is contemplated that the vacuum cleaner 10 can include any or all of the various systems and components described in FIG. 1, including a recovery system 14 for separating and storing dirt or debris from the surface to be cleaned. The various systems and components schematically described for FIG. 1 can be supported by either the base assembly 34 or the upright assembly 32 of the vacuum cleaner 10 or both in combination.

Figure 3:
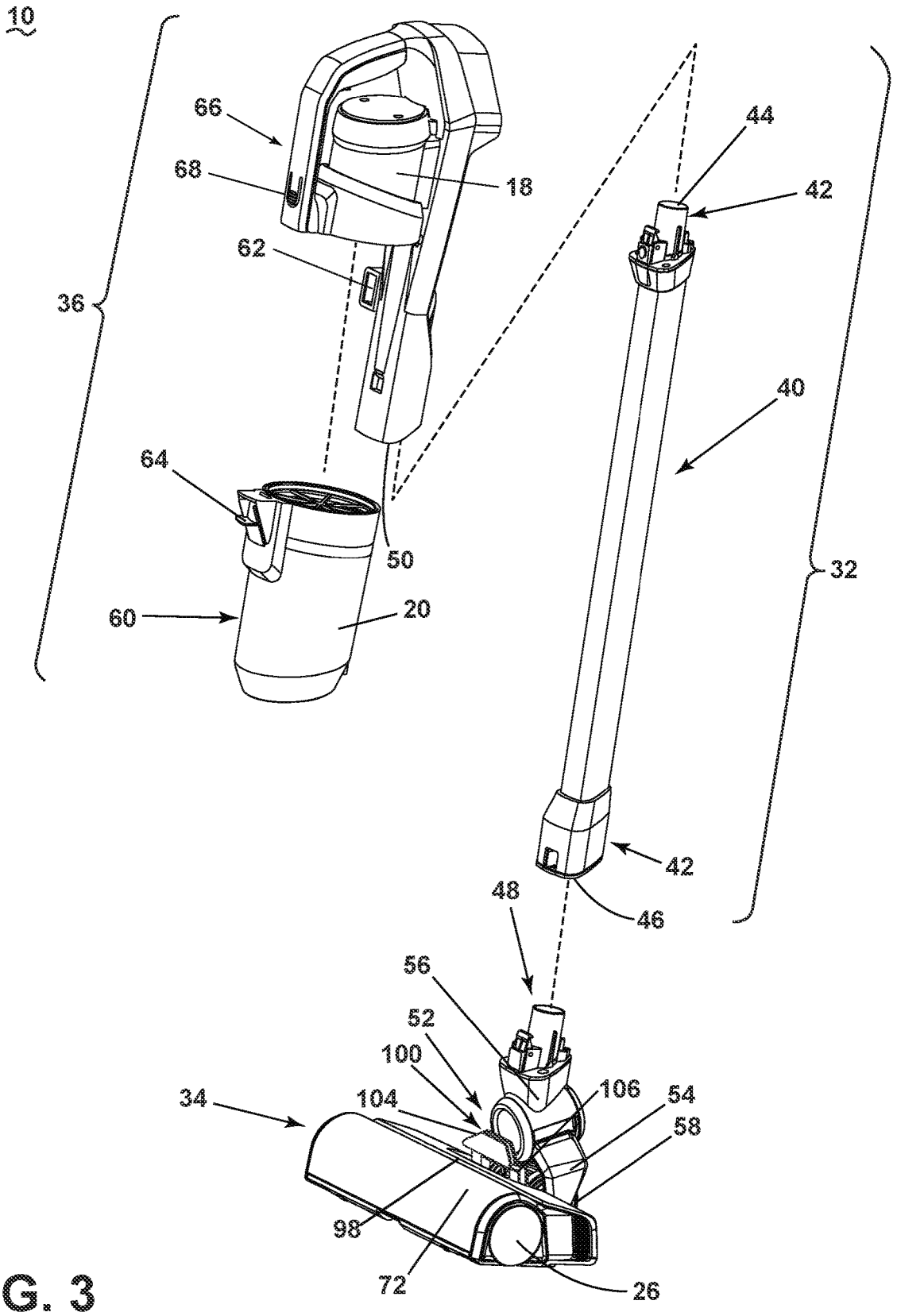
FIG. 3 is a partially-exploded view of the vacuum cleaner of FIG. 2, further including a brake assembly.

FIG. 3 illustrates a partially-exploded view of the vacuum cleaner 10 of FIG. 2. The upright assembly 32 includes a hand-held portion 36 supporting components of the recovery system 14, including, but not limited to, the suction source 18 and the recovery container 20. By way of non-limiting example, the suction source 18 can include a motor/fan assembly.

The hand-held portion 36 can be coupled to a wand 40 having at least one wand connector 42. In the illustrated example, both a first end 44 of the wand 40 and a second end 46 of the wand 40 include a wand connector 42. The wand connector 42 at the second end 46 of the wand 40 can be coupled to the base assembly 34 via a wand receiver 48. The wand connector 42 at the first end 44 of the wand 40 can couple to a second wand receiver 50 within the hand-held portion 36. It is contemplated that the wand connectors 42 can be the same type of connector or can vary in any suitable manner with respect to function, structure, design, profile, etc. Any suitable type of connector mechanism can be utilized, such as a quick connect mechanism or a tubing coupler in non-limiting examples.

A pivotal connection between the upright assembly 32 and the base assembly 34 can be provided by at least one pivoting mechanism. In the illustrated example, the pivoting mechanism can include a multi-axis swivel joint assembly 52 configured to pivot the upright assembly 32 from front-to-back and side-to-side with respect to the base assembly 34. However, this need not be the case and the pivoting mechanism can move in any suitable manner including that the upright assembly 32 may pivot about one single axis with respect to the base assembly 34. A lower portion 54 of the swivel joint assembly 52 is located between the wand 40 and the base assembly 34. The lower portion 54 of the swivel joint assembly 52 provides for pivotal forward and backward rotation between the wand 40 and the base assembly 34. An upper portion 56 of the swivel joint assembly 52 is also located between the wand 40 and the base assembly 34 and provides for lateral or side-to-side rotation between the wand 40 and base assembly 34. By way of non-limiting example, the lower portion 54 of the swivel joint assembly 52 is coupled between the base assembly 34 and the upper portion 56 of the swivel joint assembly 52. The upper portion 56 of the swivel joint assembly 52 is coupled to the wand receiver 48 at the second end 46 of the wand 40. Wheels 58 can be coupled to the lower portion 54 of the swivel joint assembly 52 or directly to the base assembly 34, and are adapted to move the base assembly 34 across the surface to be cleaned.

A brake assembly 100 can be provided with the base assembly 34. The brake assembly 100 can be located on an upper portion of the base assembly 34. By way of non-limiting example, the brake assembly 100 can be defined by a body 102 with at least a portion of the body extending into the base assembly 34 and another portion extending beyond an upper surface 98 of the base assembly 34. As a non-limiting example, the body 102 can be include an upper portion or a handle 104 and at least one lower portion or at least one leg 106. The handle 104 can extend beyond the upper surface 98 of the base assembly 34 such that the handle 104 is accessible to a user. The at least one leg 106 can extend at least partially into the base assembly 34 adjacent the wheels 58, such that the at least one leg confronts, contacts, or is adjacent to at least one of the wheels 58. In the illustrated example, the brake assembly 100 is near the pivotal connection between the upright assembly 32 and the base assembly 34.

The hand-held portion 36 can also include the recovery container 20, illustrated herein as a dirt separation and collection module 60 fluidly coupled to the suction source 18 via an air outlet port 62. The dirt separation and collection module 60 can be removable from the hand-held portion 36 by a release latch 64 as shown so that it can be emptied of debris. Additional details of the dirt separation and collection module and the cleaning apparatus are described in PCT Application No. PCT/US19/39424, filed Jun. 27, 2019, which is incorporated herein by reference in its entirety.

An upper end of the hand-held portion 36 can further include a hand grip 66 for maneuvering the vacuum cleaner 10 over a surface to be cleaned and for using the vacuum cleaner 10 in hand-held mode. At least one control mechanism 68 is provided on the hand grip 66 and coupled to the power source 22 (FIG. 1) for selective operation of components of the vacuum cleaner 10. In the contemplated example, the at least one control mechanism 68 is an electronic control that can form the suction power switch 24.

The agitator 26 of the illustrated aspect includes a brushroll 70 (FIG. 4) configured to rotate about a horizontal axis and operatively coupled to a drive shaft of a drive motor via a transmission, which can include one or more belts, gears, shafts, pulleys, or combinations thereof. An example of which will be explained in more detail below. An agitator housing 72 is provided around the suction nozzle 16 and defines an agitator chamber 74 (FIG. 4) for the brushroll 70 (FIG. 4).

Figure 4:
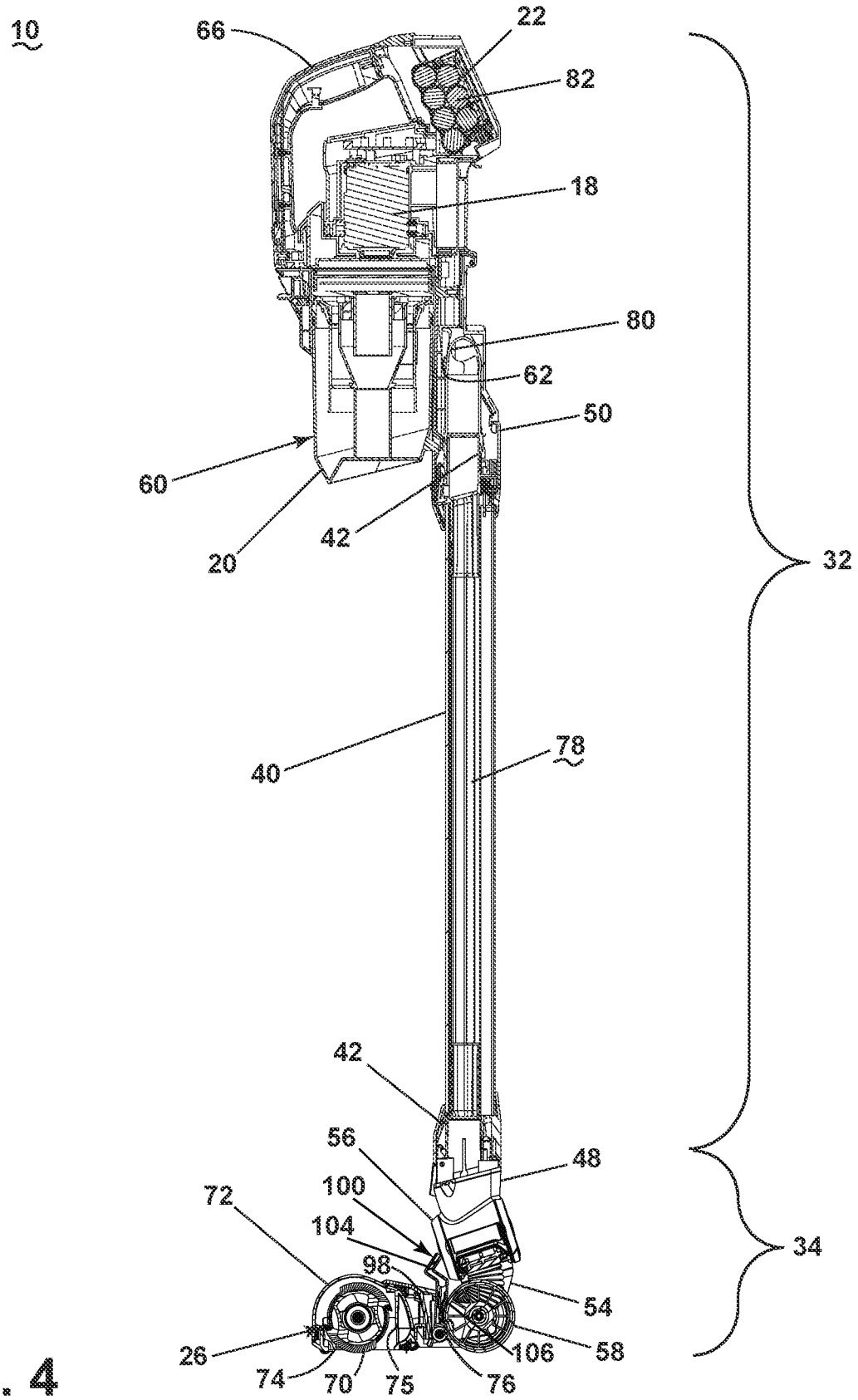
FIG. 4 is a side sectional view of the vacuum cleaner including the brake assembly of FIG. 2 along line IV-IV.

Referring now to FIG. 4, a recovery airflow conduit 75 can be formed between the agitator housing 72 and the dirt separation and collection module 60. For example, a hose conduit 76 in the base assembly 34 can be fluidly coupled to a wand central conduit 78 within the wand 40. The hose conduit 76 can be flexible to facilitate pivoting movement of the swivel joint assembly 52 about multiple axes. The wand central conduit 78 is fluidly connected to a dirt inlet 80 on the dirt separation and collection module 60 via the air outlet port 62.

In the illustrated example, the power source 22 is in the form of a battery pack 82 containing one or more batteries, such as lithium-ion (Li-Ion) batteries. Optionally, the vacuum cleaner 10 can include a power cord (not shown) to connect to a wall outlet. In still another example, the battery pack 82 can include a rechargeable battery pack, such as by connecting to an external source of power to recharge batteries contained therein.

During operation of the vacuum cleaner 10, the power source 22 can supply power for the suction source 18, such as by way of non-limiting example a motor/fan assembly to provide suction through the recovery airflow conduit 75. Debris-laden working air within the agitator housing 72 can be directed through the flexible hose conduit 76 and wand central conduit 78 before flowing into the dirt separation and collection module 60 by way of the dirt inlet 80 as shown. In addition, the swivel joint assembly 52 can provide for forward/backward and side-to-side pivoting motion of the upright assembly 32 with respect to the base assembly 34 when moving the base assembly 34 across the surface to be cleaned. Additional details of the motor/fan assembly are described in U.S. Pat. No. 10,064,530, issued Sep. 4, 2018, which is incorporated herein by reference in its entirety.

Figure 5:
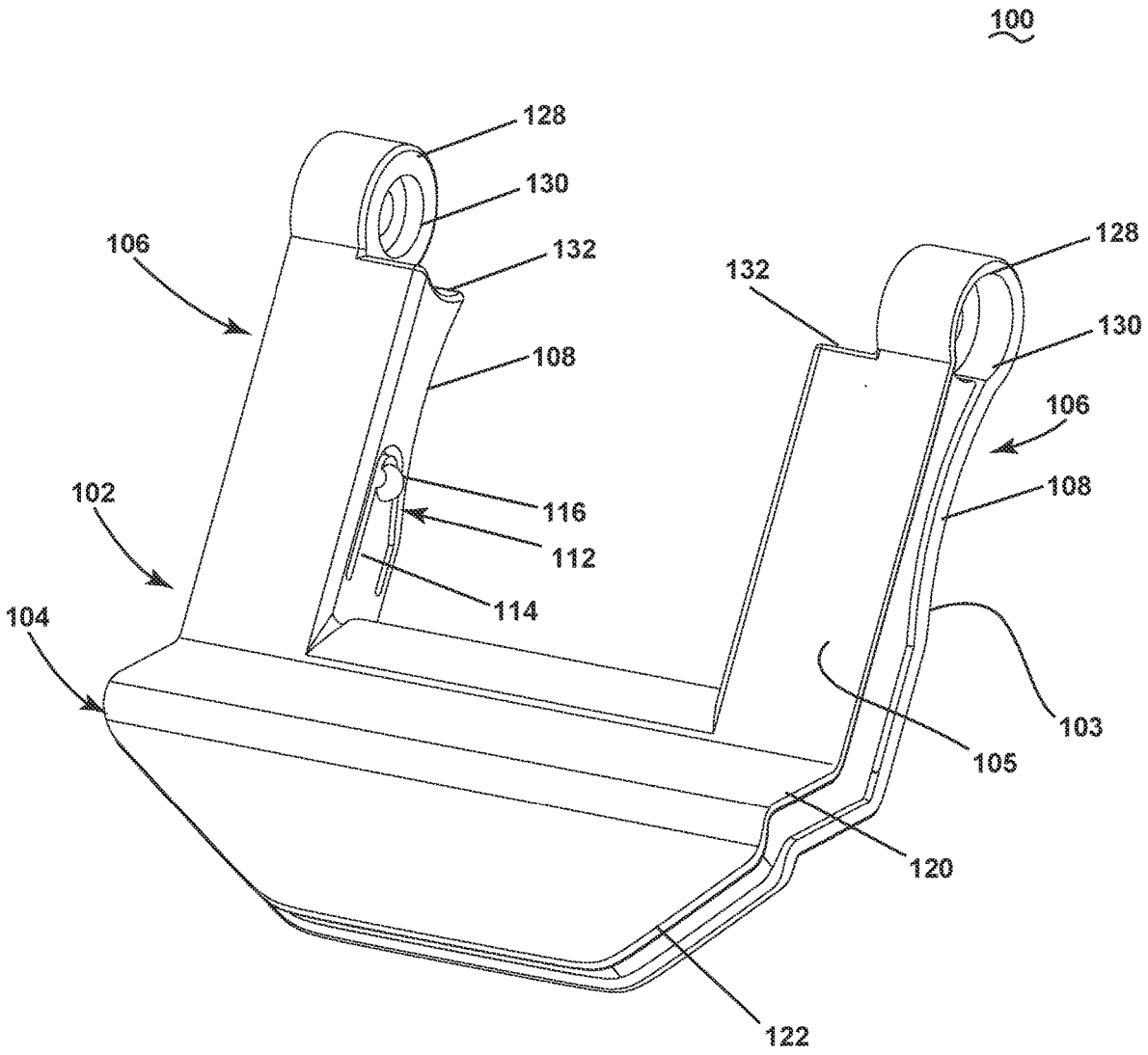
FIG. 5 is a perspective view of the brake assembly of FIG. 2.

FIG. 5 is a perspective view of the body 102 of the brake assembly 100 of FIG. 2. As illustrated, the body 102 can include the handle 104 and a set of legs 106. In a of non-limiting example, the two legs 106 are spaced from one another. The handle 104 can extend from a portion of one of the legs 106 to a corresponding portion of the adjacent leg 106. As such, the handle 104 can span the space between the set of legs 106 and operatively couple the legs 106 to one another. Although illustrated as a brake assembly 100 including two legs 106, it will be appreciated that there can be any number of one or more legs 106. For example, the brake assembly 100 can include a single leg 106 with the handle 104 projecting outward from a portion of the leg 106. The body 102 can be further defined by a first side 103 and a second side 105 opposite the first side 103.

The handle 104 can include a first portion 120 and a second portion 122. The first portion 120 can be directly coupled to the set of legs 106, while the second portion 122 can be spaced from the set of legs 106 and define a distal end of the brake assembly 100. The first portion 120 can extend in a direction oblique to a direction of extension of the second portion 122. As such, the first portion 120 can be obliquely oriented with respect to the second portion 122. Alternatively, the first portion 120 can be normal to the second portion 122. In either case, the first portion 120 and the second portion 122 are non-parallel. This orientation of the first portion 120 and the second portion 122 can form a grip of the handle 104 such that the user can easily grasp the handle 104 of the brake assembly 100. As such, the brake assembly 100 can be further defined as a brake assembly 100 including an ergonomic handle 104.

The set of legs 106 are illustrated as extending from the first portion 120 of the handle 104. Each leg 106 can extend in the same direction away from the section of the body 102 defining the handle 104. In the illustrated example, the legs 106 can be spaced from one another and the width of the handle 104 span the space between the set of legs 106. Further, the set of legs 106 are illustrated to be parallel to one another, however, it will be appreciated that he legs 106 can be non-parallel.

Each leg 106 can include a foot 128 defining a distal end of the set of legs 106, opposite a handle 504. The foot 128 can extend across only a portion of the width of each leg 106. By way of non-limiting example, the foot 128 can extend across 50% of the width of a corresponding leg 106. In one non-limiting example, the foot 128 can be formed as a cylinder. It will be appreciated, however, that the foot 128 can have any suitable geometric configuration. A remaining 50% of the width of the leg 106 that does not include the foot 128 can include a cut out 132 with a shape corresponding to the foot 128. As such, the cut out 132 can be formed as a cylindrical cut out 132 along a distal portion of the legs 106. Alternatively, the foot 128 can extend the same width as the leg.

A passageway or through hole 130 can extend through a portion of the foot 128 from one end or side to the other. In the non-limiting example illustrated, the through hole 130 can be formed as a concentric cylinder within the cylinder defined by the foot 128. It is contemplated, by way of non-limiting example, as illustrated, that the through hole 130 can have a varying cross-sectional area from one end of the foot 128 to the other. For example, the cross-sectional area of the through hole 130 can be larger at one end to define a seat for a fastener that can be used to couple the brake assembly 100 the vacuum cleaner 10. It will be appreciated, however, that the through hole 130 can have any suitable cross-sectional area along any portion of the through hole 130. For example, the through hole 130 can have a constant cross-sectional area.

The set of legs 106 can further include a set of grooves 108 provided on the first side 103 of the body 102. The set of grooves 108 can define a portion of the body 102 where the first side 103 converges toward the second side 105. In other words, the set of grooves 108 can define a depression formed within the body 102 of the brake assembly 100. By way of non-limiting example, the set of grooves 108 can be within a portion of the set of legs 106. As illustrated, the set of grooves 108 can be formed as a rounded, concave portion of the set of legs 106. Alternatively, the set of grooves 108 can be formed as any suitable geometric portion depression of concave portion of the set of legs 106.

A lock 112 can be included along an interior portion of the set of legs 106. The lock 112 can confront the space between the set of legs 106 although it is contemplated that it could be located on the exterior. The lock 112 can include an arm 114 connected to a corresponding leg 106 at one end. The remainder of the arm 114 can be separated from the body of the corresponding leg 106 thus forming a gap between the arm 114 and the leg 106, as illustrated. The gap can extend around the entirety of the arm 114 besides where the arm 114 connects to the set of legs 106. A protrusion 116 can extend away from a distal end of the arm 114 and confront the space between the set of legs 106. The protrusion 116 is illustrated, by way of non-limiting example as a in the form of a semi-sphere. Although illustrated as a single lock 112 on a single leg 106, it will be appreciated that there can be any number of locks 112. For example, each leg 106 of the set of legs 106 can include a lock 112 on the interior portion of the corresponding leg 106.

The arm 114 can include a section having a different shape, profile, configuration, size, etc. from a remainder of the arm 114. As a non-limiting example, the profile of the arm 114 can remain constant. Alternatively, the profile or width of the arm 114 can vary along the length of the arm 114. It will be appreciated that the arm 114 can have any suitable profile and that the width, shape, profile, size, or thickness can vary along the length of the arm 114 constantly, linearly, non-constantly, or non-linearly.

As illustrated, the body 102 of the brake assembly 100 is hollow such that a void is formed between the first side 103 and the second side 105. As a portion of the arm 114 is separated from the body of the set of legs 106, it will be appreciated that the lock 112 can move at least partially into the void from the illustrated position by applying a force onto a portion of the lock 112. As a non-limiting example, the protrusion 116 of the lock 112 can move at least partially into the void of the set of legs 106. As such, the lock 112 can be further defined as a spring biased to an original position (e.g., the illustrated position where an outer surface of the arm 114 is aligned with the outer surface of the corresponding leg 106).

Figure 6:
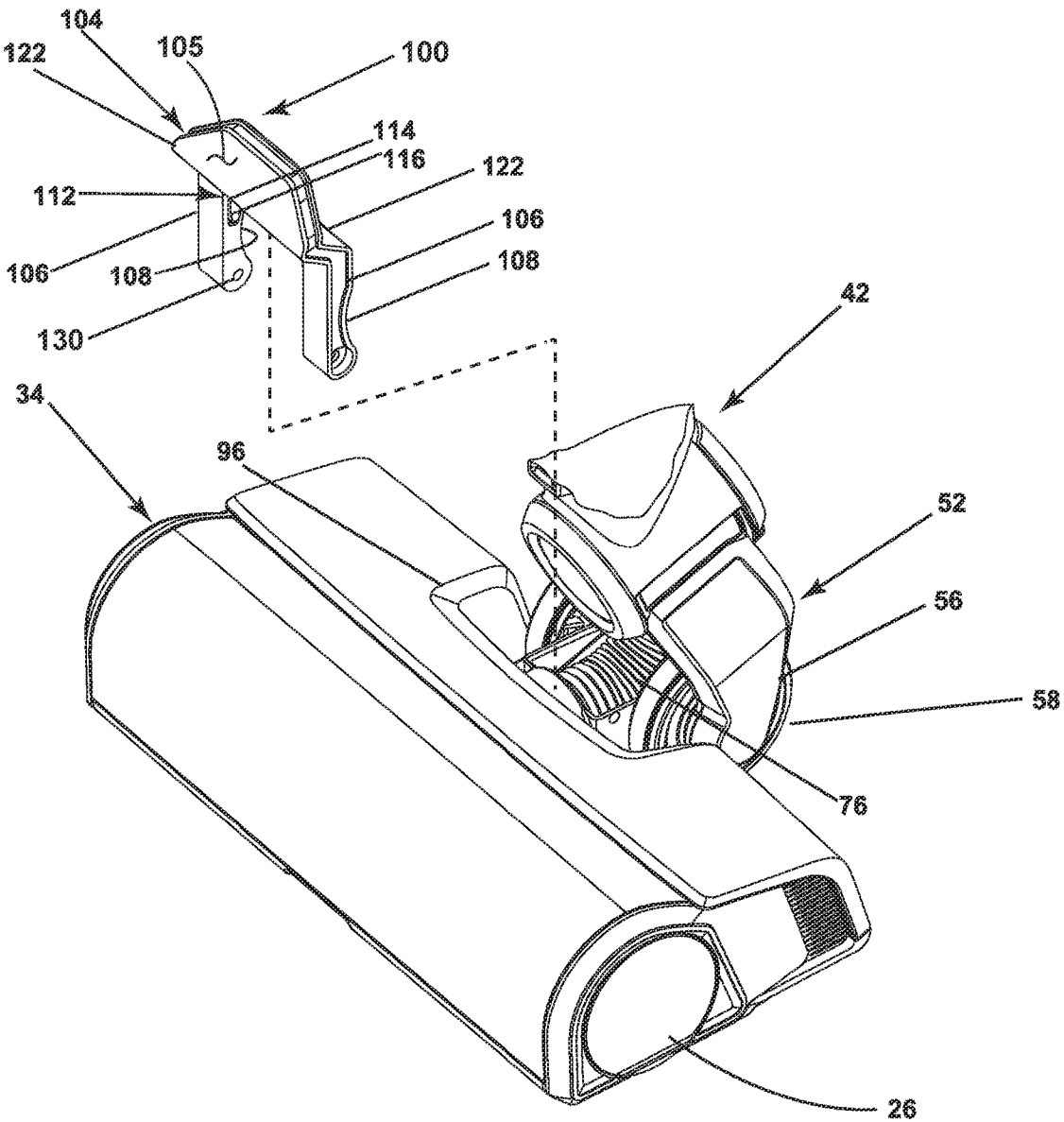
FIG. 6 is a perspective view of the base assembly of FIG. 2 with the brake assembly exploded.

FIG. 6 is an exploded perspective view of the brake assembly 100 and the base assembly 34 of FIG. 2. As illustrated, the base assembly 34 can include a brake housing 96. The wheels 58 can extend into at least a portion of the brake housing 96. The hose conduit 76 can extend through the brake housing 96 between the wheels 58, thus diving the brake housing 96 into two separate areas. The brake assembly 100 can straddle the hose conduit 76 such that each leg 106 extends into a corresponding area of the brake housing 96.

Figure 7:
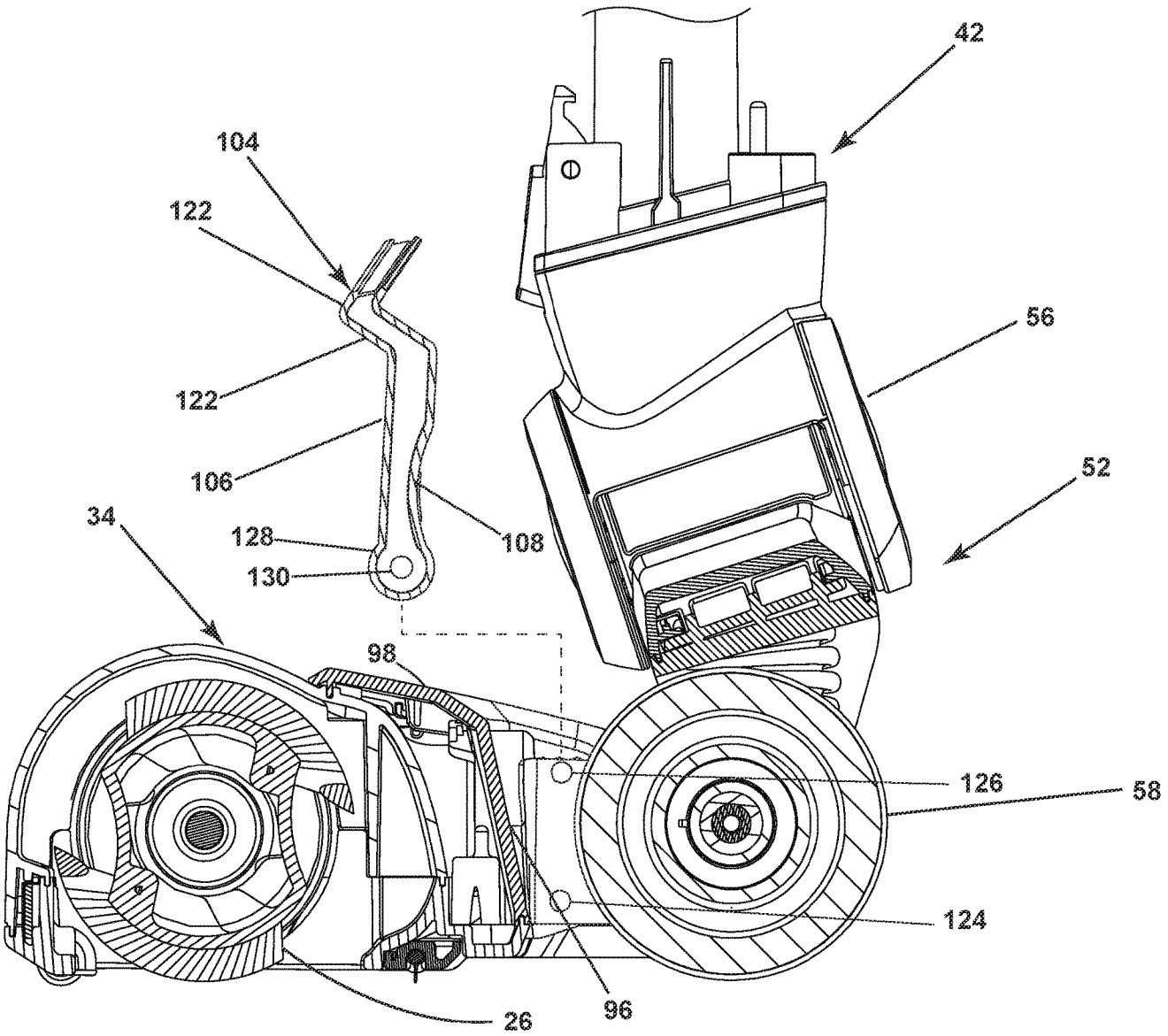
FIG. 7 is a sectional view of the base assembly of FIG. 6, taken along line VII-VII of FIG. 2, and with the brake assembly exploded.

FIG. 7 is a sectional view of the brake assembly 100 and the base assembly 34 of FIG. 6, as seen from cut VII-VII of FIG. 2, and with the brake assembly 100 exploded from the base assembly 34. The base assembly 34 can further include a projection 124 and a divot 126.

When the brake assembly 100 is positioned within the base assembly 34, the projection 124 can rest within or against the cut out 132. It is contemplated that a portion of the projection 124 can extend into at least a portion of the through hole 130, thus coupling the brake assembly 100 to the base assembly 34. The foot 128 including the through hole 130, the cut out 132, and the projection 124, together, can define a center of rotation of the brake assembly 100 and a first point of coupling between the base assembly 34 and the brake assembly 100.

At least a portion of the lock 112 can be releasably secured within the divot 126. The protrusion 116 can be releasably secured within the divot 126. As such, the divot 126 can define a second point of coupling between the brake assembly 100 and the base assembly 34.

Figure 8:
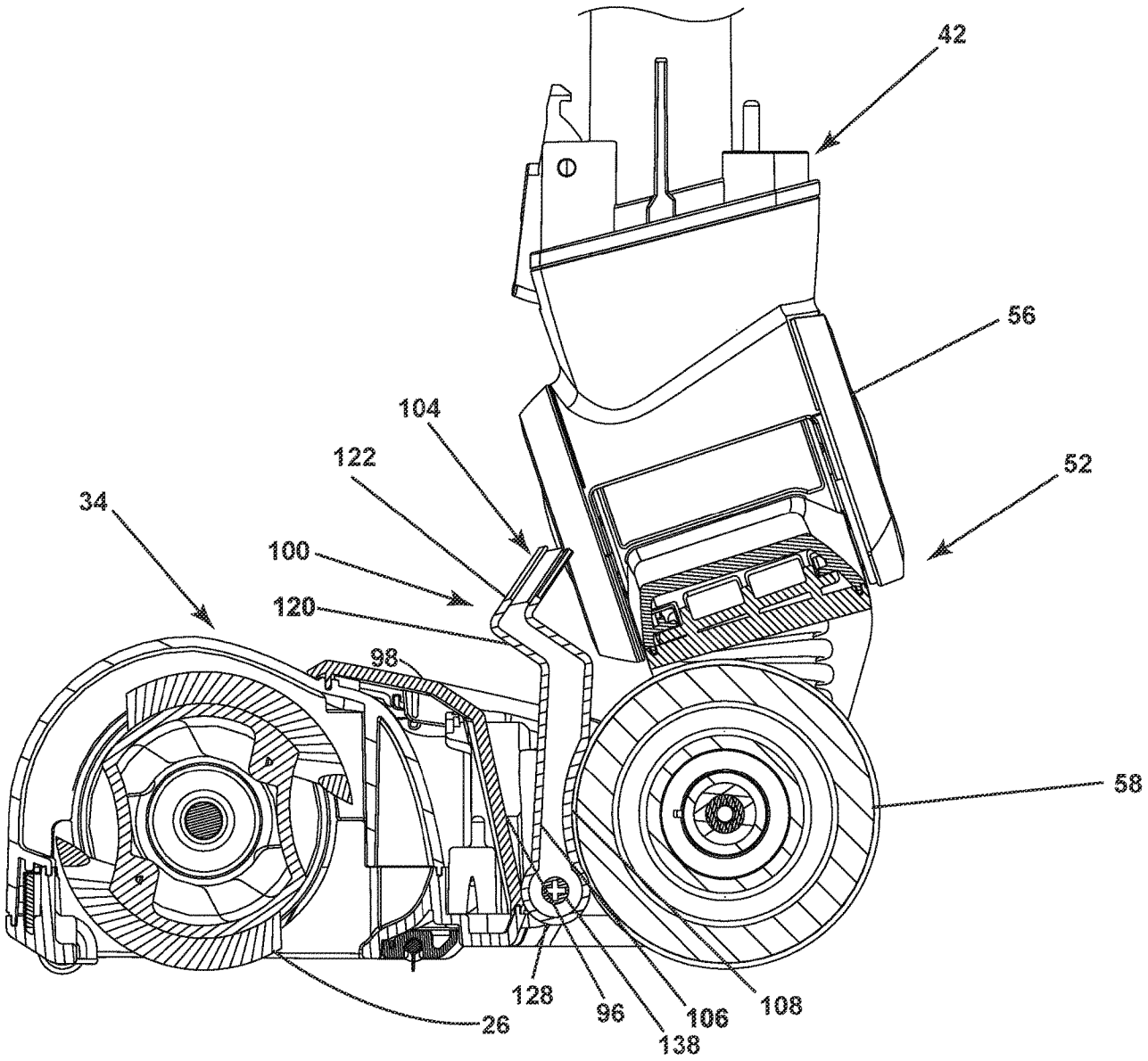
FIG. 8 is the sectional view of the base assembly of FIG. 7, including the brake assembly non-exploded and in a first position.

FIG. 8 is the sectional view of the base assembly 34 of FIG. 7, as seen from cut VII-VII of FIG. 2, with the brake assembly 100 no longer exploded from the base assembly 34. As illustrated, the brake assembly 100 is in a first position or a locked position.

As illustrated, the groove 108 of one of the legs 106 confronts or otherwise is in direct contact with at least one of the wheels 58. Although only one of the legs 106 is illustrated to be in contact with one wheel 58, it will be appreciated that this description can be applied to any leg 106 of the set of legs 106. As such, in the case of the brake assembly 100, one leg 106 can confront a wheel 58 while another adjacent leg 106 can confront a separate, adjacent wheel 58.

It is contemplated, however, that the projection 124 can further be defined as a bore such that a fastener 138 can be threaded through the through hole 130 of the brake assembly 100 and into a portion of the projection 124. As such, the fastener 138 can couple the brake assembly 100 to the base assembly 34. The fastener 138, the foot 128 including the through hole 130, the cut out 132, and the projection 124, together, can define the center of rotation of the brake assembly 100. As a non-limiting example, the fastener can be any suitable fastener such as, but not limited to, a push pin, a tab, a pin, a screw, a nail, a protrusion, or any combination thereof.

In the first position, the lock 112 of the brake assembly 100 is engaged within a corresponding portion of the base assembly 34. As a non-limiting example, the protrusion 116 of the lock 112 is engage within the divot 126 of the base assembly 34. This engagement prevents unintentional rotational movement of the brake assembly 100. In other words, the brake assembly 100 will not move from the first position unless an external force is applied to the brake assembly 100. As such, the groove 108 remains in contact with the wheels 58. The external force can be any suitable force that can cause the arm 114 to move inward from its biased position. For example, the external force can be, but is not limited to, a user moving the brake assembly 100 over a portion of the base assembly 34 that projects toward the lock 112 and will cause the lock 112 to move inward when moved over it.

In the first position, the protrusion 116 of the lock 112 is positioned within the divot 126 (FIG. 7), thus locking the brake assembly in the illustrated position. As used herein, the term "locked", "locking", "lock" or iterations thereof refers to the prevention or limitation of movement of a moveable object (e.g., the brake assembly 100). Although discussed in terms of the protrusion 116 of the lock 112 fitting within the divot 126 to lock the brake assembly 100 in the first position, it will be appreciated that any other suitable locking mechanism can be used such as, but not limited to, a spring, a hook, a magnet, a lever, a body moveable between different set positions such as through a series of detents, or any combination thereof. The engagement between the grooves 108 and the wheels 58 prevents the rotation of the wheels 58. As such, when the brake assembly 100 is in the first position, the wheels 58 will not rotate as they are locked in position. Further, when in the first position, at least a portion of the vacuum cleaner 10 can rest against or otherwise contact the handle 104. As a non-limiting example, when in the first position, at least a portion of the vacuum cleaner 10 can rest against the second portion 122 of the handle 104. As illustrated, the upper portion 56 of the swivel joint assembly 52 can rest against the second portion 122 of the handle 104. As such, the vacuum cleaner 10 can be stood upright, and remain upright, by positioning the brake assembly 100 in the first position as illustrated.

Figure 9:
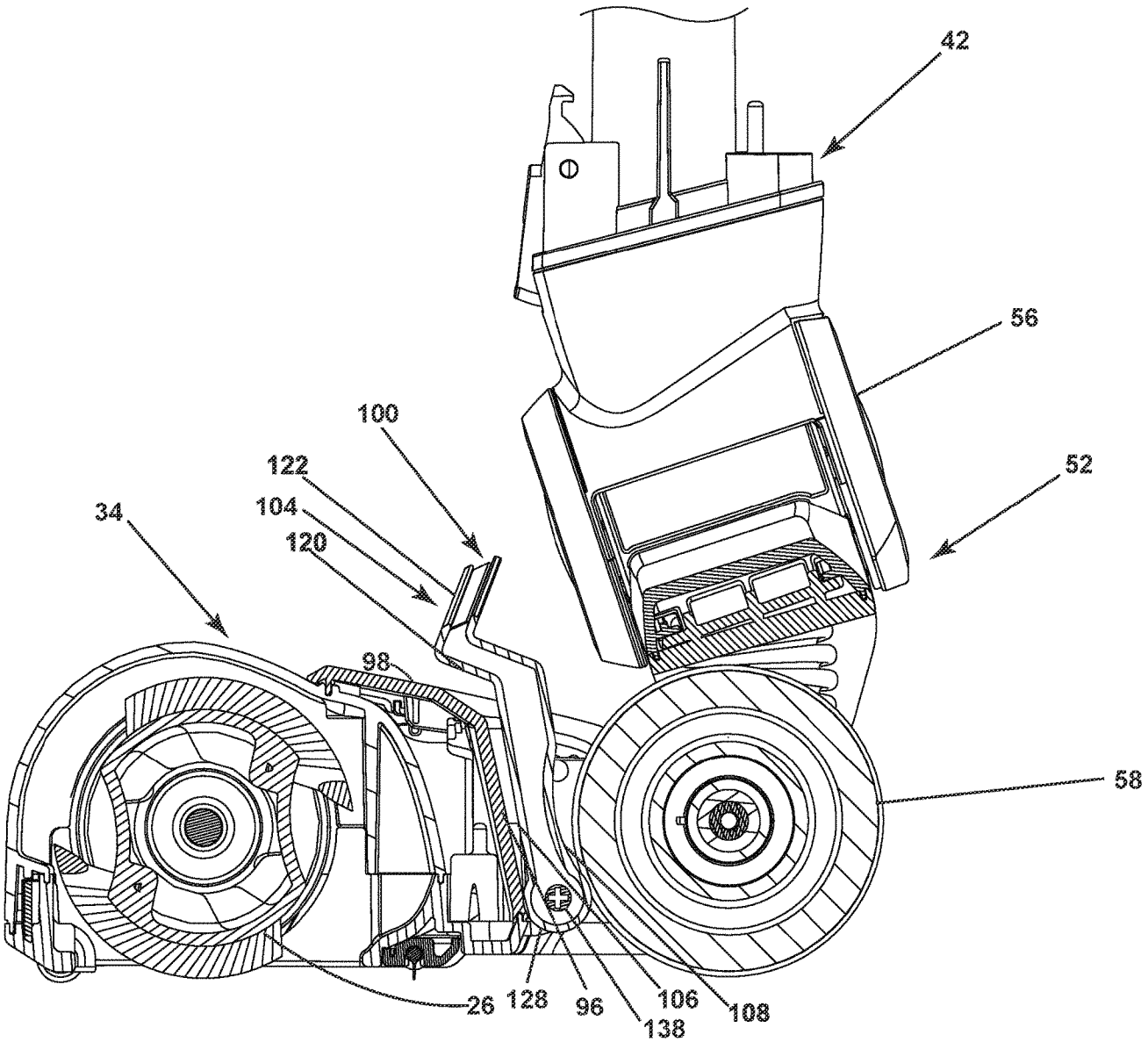
FIG. 9 is the sectional view of the base assembly of FIG. 8, with the brake assembly in a second position.

FIG. 9 is the sectional view of the base assembly 34 of FIG. 8, as seen from cut VII-VII of FIG. 2. As illustrated, the brake assembly 100 is in a second position defined as an unlocked position.

In the second position, the grooves 108 the set of legs 106 are no longer in contact with the wheels 58. The protrusion 116 of the lock is removed from the divot 126. As such, the wheels 58 are not engaged by a portion of the brake assembly 100. As such, the wheels 58 are free to rotate. When in the second position, the brake assembly 100 can rest against the base assembly 34. As a non-limiting example, the brake assembly 100 can rest against an inner wall of the brake housing 96 although this need not be the case. Further, in the second position, the swivel joint 52 no longer contacts the handle 104. As such, the upright assembly 32 of the vacuum cleaner 10 is free to swivel about a pivot defined by the joint assembly 52.

In operation, the brake assembly 100 can transition between the first position and the second position to selectively engage the wheels 58. In the first position, the grooves 108 of the brake assembly 100 can contact the wheels 58, thus restricting rotational movement of the wheels 58. In the second position, the brake assembly 100 can be displaced from or otherwise not contact the wheels 58, thus allowing for the free rotational movement of the wheels 58. As discussed herein, the brake assembly 100 can be selectively locked or unlocked. This selective locking can be done at least partially through the lock 112. As a non-limiting example, the selective locking can be determined by whether or not the protrusion 116 of the lock is engaged with or otherwise positioned within the divot 126 of the base assembly 34.

During the locking and unlocking of the brake assembly 100, the lock 112 is compressed inward into the hollow portion the leg 106 when the external force is applied to the brake assembly 100. As a non-limiting example, the arm 114 of the lock 112 is compressed inward into the hollow portion of the leg 106 when the external force is applied to the brake assembly 100. Once the brake assembly 100 is rotated such that the protrusion 116 overlays the divot 126, the arm 114 will "snap-back" or otherwise move back to the position it biases (the position illustrated in FIG. 5). As such, the protrusion 116 will be nested within the divot 126, and the brake assembly 100 will be locked in place. The external force can once again be applied to rotate the brake assembly 100. The arm 114 will once again be compressed inward into the hollow of the legs 106 and the protrusion will be removed from the divot 126. As such, the brake assembly 100 will be unlocked from the first position. As a non-limiting example, the external force can be from moving a portion of the vacuum cleaner 10 and contacting the brake assembly 100. For example, the user can push the upright assembly 32 forward such that a portion of the upper portion 56 of the swivel joint assembly 52 can come apply a force to a portion of the brake assembly 100. In the illustrated example, the second portion 122 of the handle 104. This, in turn, can cause the brake assembly 100 to unlock from the first position and rotate toward the second position, thus unlocking the wheels 58 through movement of the swivel joint assembly 52.

This method of moving the brake assembly 100 can be used during operation of the vacuum cleaner 10 when it is desired to lock or stop movement of the wheels 58, as discussed herein. Further yet, in the first position, the upright assembly 32 can confront a portion of the brake assembly 100 thus propping-up or retaining the upright assembly 32 in the upright position. If the brake assembly 100 were not present, the wheels 58 would be free to rotate. The weight from the upright assembly 32 and hand-held portion 36 could then cause the wheels 58 to rotate and the base assembly 34 would "slide out" from the remainder of the vacuum cleaner 10. As used herein, the phrase "slide out" can refer to the unintentional and undesired movement of the base assembly 34 through rotation of the wheels 58 that can cause the upright assembly 32 and hand-held portion 36 to fall from its upright position. This can ultimately result in at least a portion of the vacuum cleaner 10 falling to the ground or against a surrounding object. The implementation of the brake assembly 100, however, ensures that the base assembly 34 cannot slide out from underneath the remainder of the vacuum cleaner 10 when the brake assembly 100 is secured in the first position. This eliminates the risk of at least a portion of the vacuum cleaner 10 falling to the ground or against a surrounding object.

Figure 10:
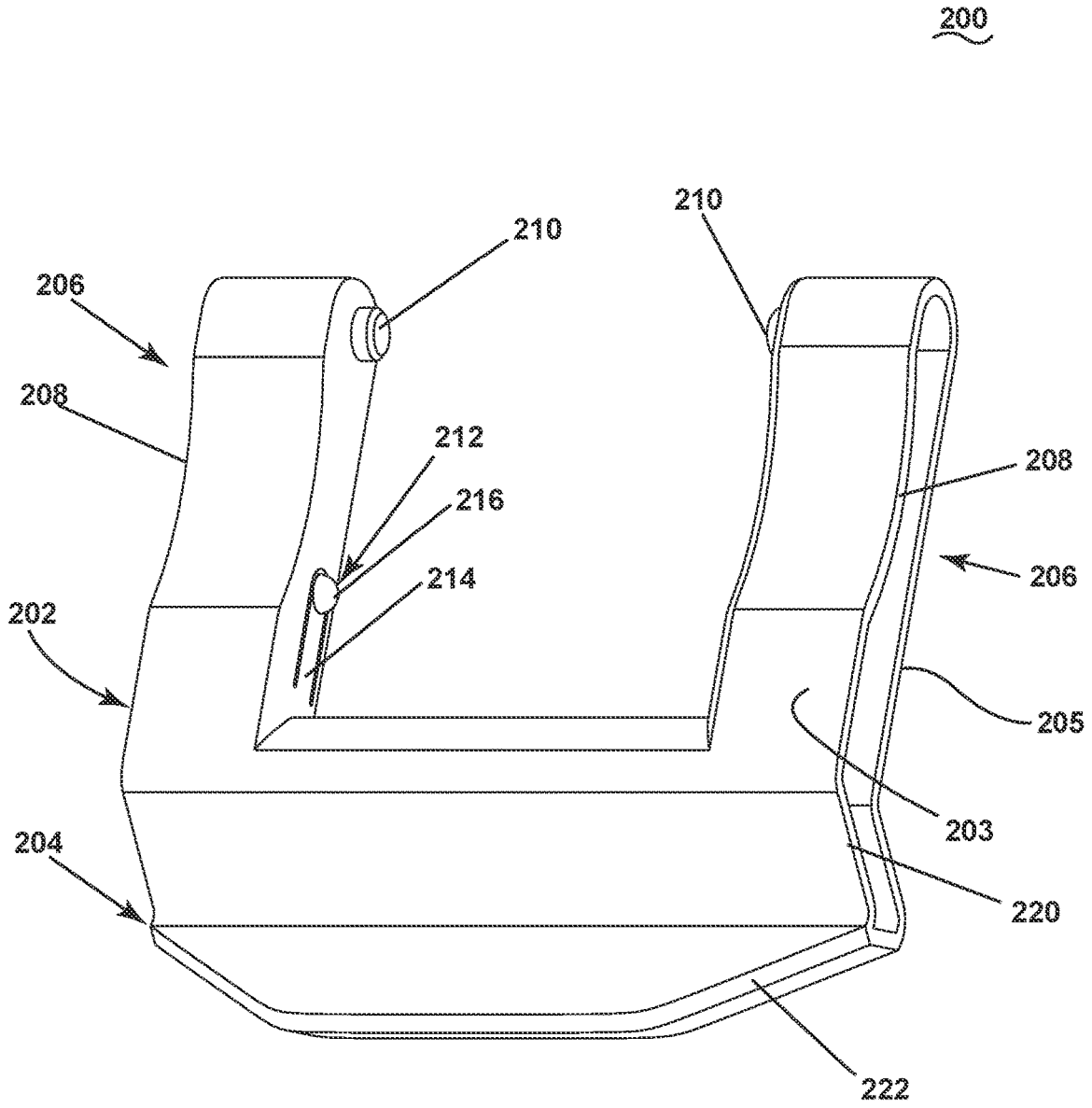
FIG. 10 is a perspective view of another exemplary brake assembly that can be utilized in the vacuum cleaner of FIG. 2.

FIG. 10 illustrates another non-limiting example of a brake assembly 200. The brake assembly 200 is similar to the brake assembly 100; therefore, like parts will be identified with like numerals in the 200 series, with it being understood that the description of the like parts of the brake assembly 100 applies to the brake assembly 200 unless otherwise noted.

The brake assembly 200 can include a set of legs 206 similar to the set of legs 106 of the brake assembly 100, but without the set of feet 128. Alternatively, the set of legs 206 can include the set of feet 128. The difference being that the set of legs 206 do not include the foot 128. Instead, the set of legs 206 have a constant width from one distal end to the other. The set of legs 206 can each further include a knob 210 extending from an inner portion of the set of legs 206 and confronting the space between the set of legs 206. It is contemplated that the knob 210 can define both a point of coupling and a pivot point of the brake assembly 200. As a non-limiting example, the projection 124 can instead be formed as a divot or include a bore such that the knob 210 can be secured within the projection 124 of the base assembly 34. The knob 210, and the projection 124 can form the center of rotation and a point of coupling between the brake assembly 200 and the base assembly 34.

The brake assembly 200 can further include a lock 212 including an arm 214 and a protrusion 216 extending from the arm 214. The lock 212 is similar to the lock 112 except that the arm 214 of the lock 212 has a constant thickness or otherwise extends linearly from one distal end coupling the arm to the legs 206 to another distal end where the protrusion 216 extends from the arm 214.

Figure 11:
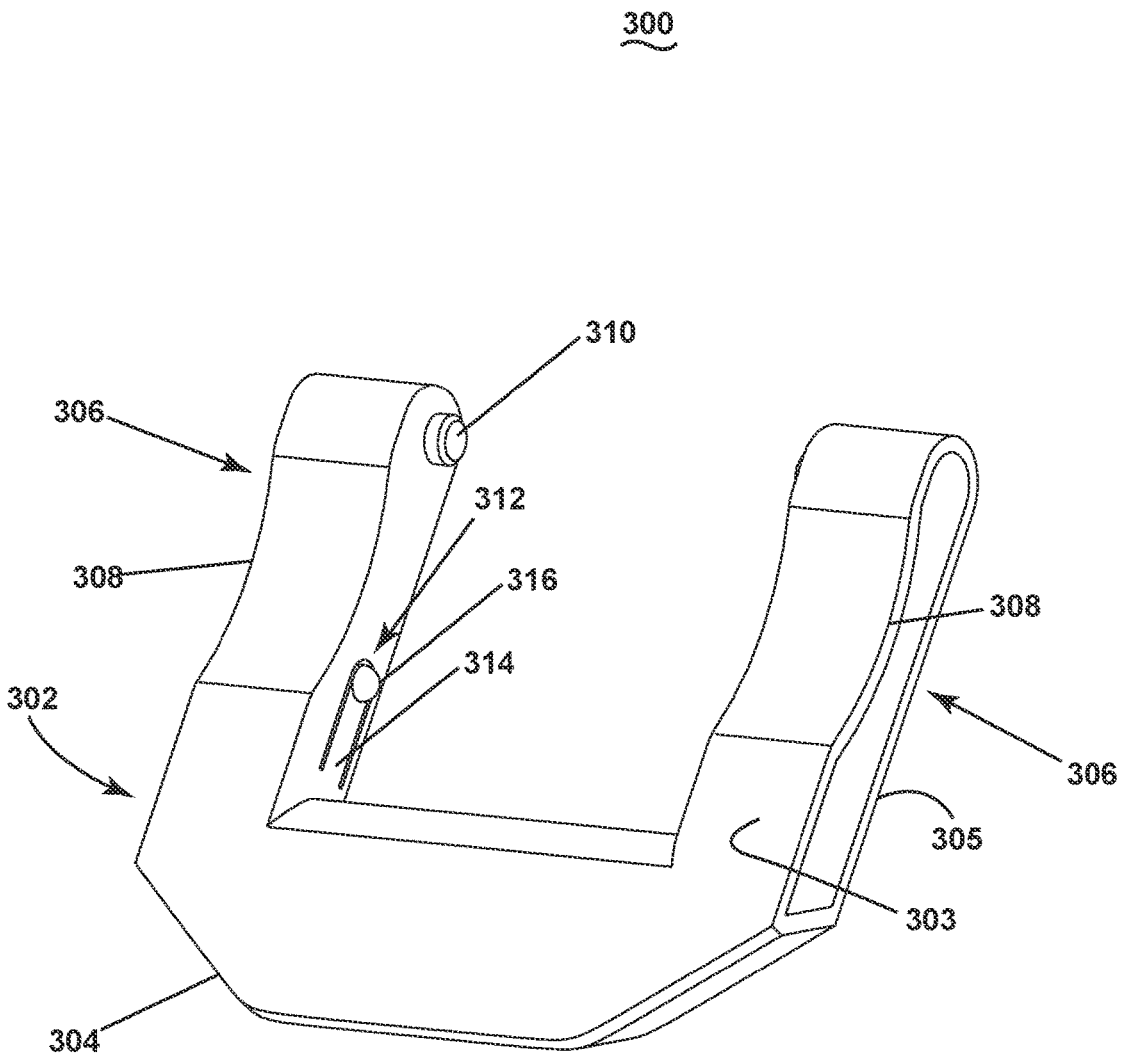
FIG. 11 is a perspective view of yet another exemplary brake assembly that can be utilized in the vacuum cleaner of FIG. 2.

FIG. 11 illustrates another non-limiting example of a brake assembly 300. The brake assembly 300 is similar to the brake assembly 100, 200; therefore, like parts will be identified with like numerals in the 300 series, with it being understood that the description of the like parts of the brake assembly 100, 200 applies to the brake assembly 300 unless otherwise noted.

The brake assembly 300 can include a set of legs 306 without the set of feet 128 of the brake assembly 100. Alternatively, the brake assembly 300 can include the set of feet 128. One difference is that the brake assembly 300 can further include a handle 304 formed as a monolithic body without the first portion 120, 220 (e.g., the angled portion) of the handle 104, 204 included with the brake assembly 100, 200. As used herein, the term "monolithic body", "integral monolithic body", or iterations thereof can refer to a single body that is a single, non-separable piece, or formed as a single unitary piece at manufacture, as opposed to being formed by combining separate elements into one during manufacture. The formation of the brake assembly 300 as a monolithic body can allow for a smaller handle 304 that does not extend as far away from the base assembly 34 when compared to the corresponding portions of the brake assembly 100, 200. As a non-limiting example, the formation of the handle 304 as a monolithic body can allow for a smaller handle 304 that does not extend as far away from the base assembly 34 when compared to the corresponding portions of the brake assembly 100, 200.

Figure 12:
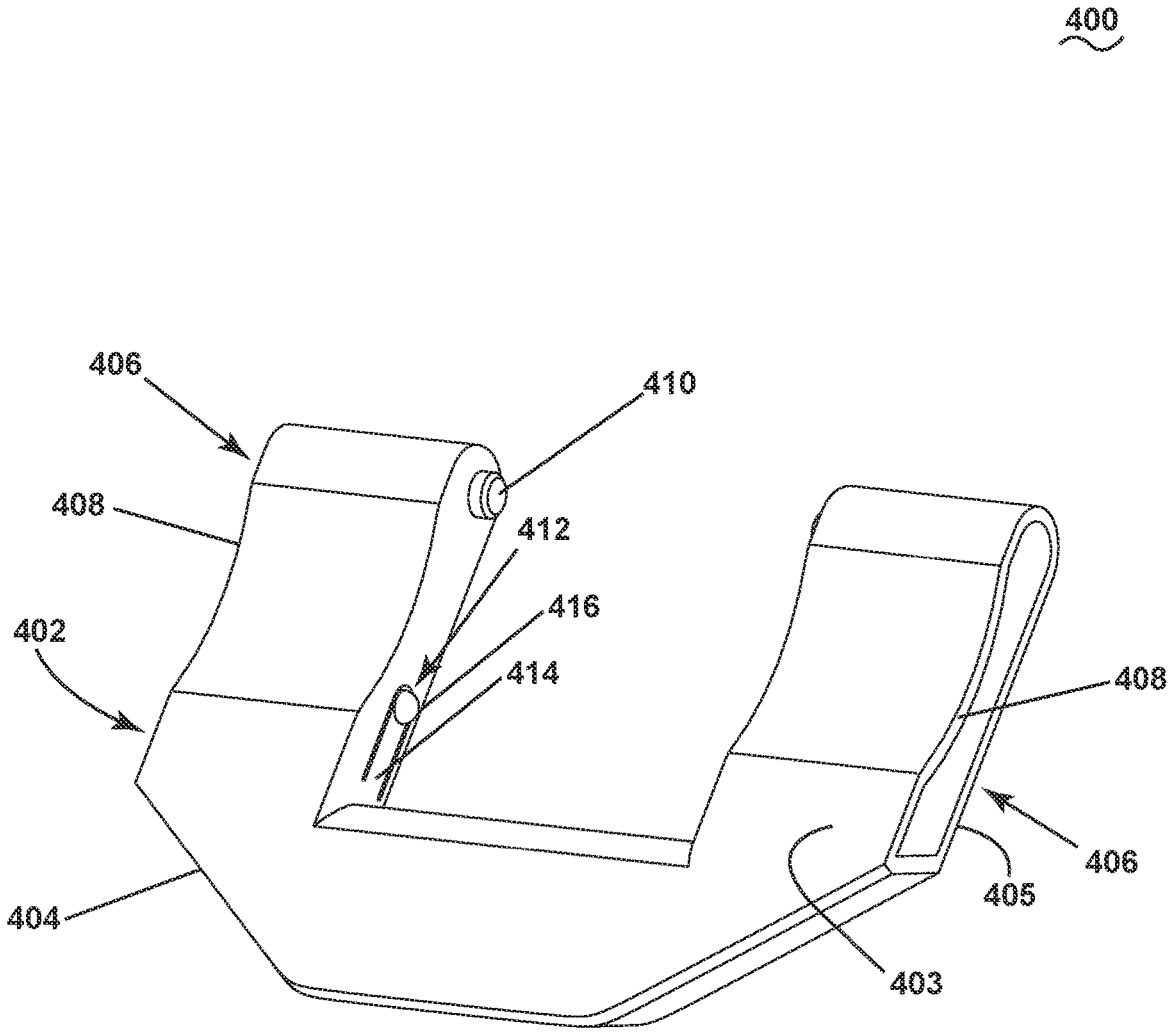
FIG. 12 is a perspective view of yet another exemplary brake assembly that can be utilized in the vacuum cleaner of FIG. 2.

FIG. 12 illustrates another non-limiting example of a brake assembly 400. The brake assembly 400 is similar to the brake assembly 100, 200, 300; therefore, like parts will be identified with like numerals in the 400 series, with it being understood that the description of the like parts of the brake assembly 100, 200, 300 applies to the brake assembly 400 unless otherwise noted.

The brake assembly 400 can include a set of legs 406 without the set of feet 128 of the brake assembly 100. Alternatively, the set of legs 406 can include he set of feet 128. The set of legs 406 can each include a groove 408, similar to the set of legs 106, 206, 306, and the groove 108, 208, 308 of the brake assembly 100, 200, 300. The legs 406, however, and hence the grooves 308 have an increased width when compared to the corresponding portions of the brake assembly 100, 200, 300. For example, the width of the set of legs 406, and hence the set of grooves 408, can two times as large as the width of the corresponding portions of the brake assembly 100, 200, 300. It will be appreciated, however, that the width of the legs 406 can be any times greater than the corresponding portions of the brake assembly 100, 200, 300.

The increased width of the set of legs 406, and the grooves 408 can allow for a greater surface area of the brake assembly 400 to engage the wheels 58 of the vacuum cleaner 10. This, in turn, can increase a frictional force applied to the wheels 58 by the set of legs 406 when compared to the corresponding portions of the brake assemblies 100, 200, 300. This ultimately increases the efficiency of the brake assembly 400 as a surface area of the wheels 58 that are engaged by the brake assembly 400, the less likely the wheels 58 will rotate. It is yet further contemplated that the brake assembly 400 can engage more than one wheel 58 per groove 408. For example, each groove 408 can be configured to engage two adjacent wheels 58.

Figure 13:
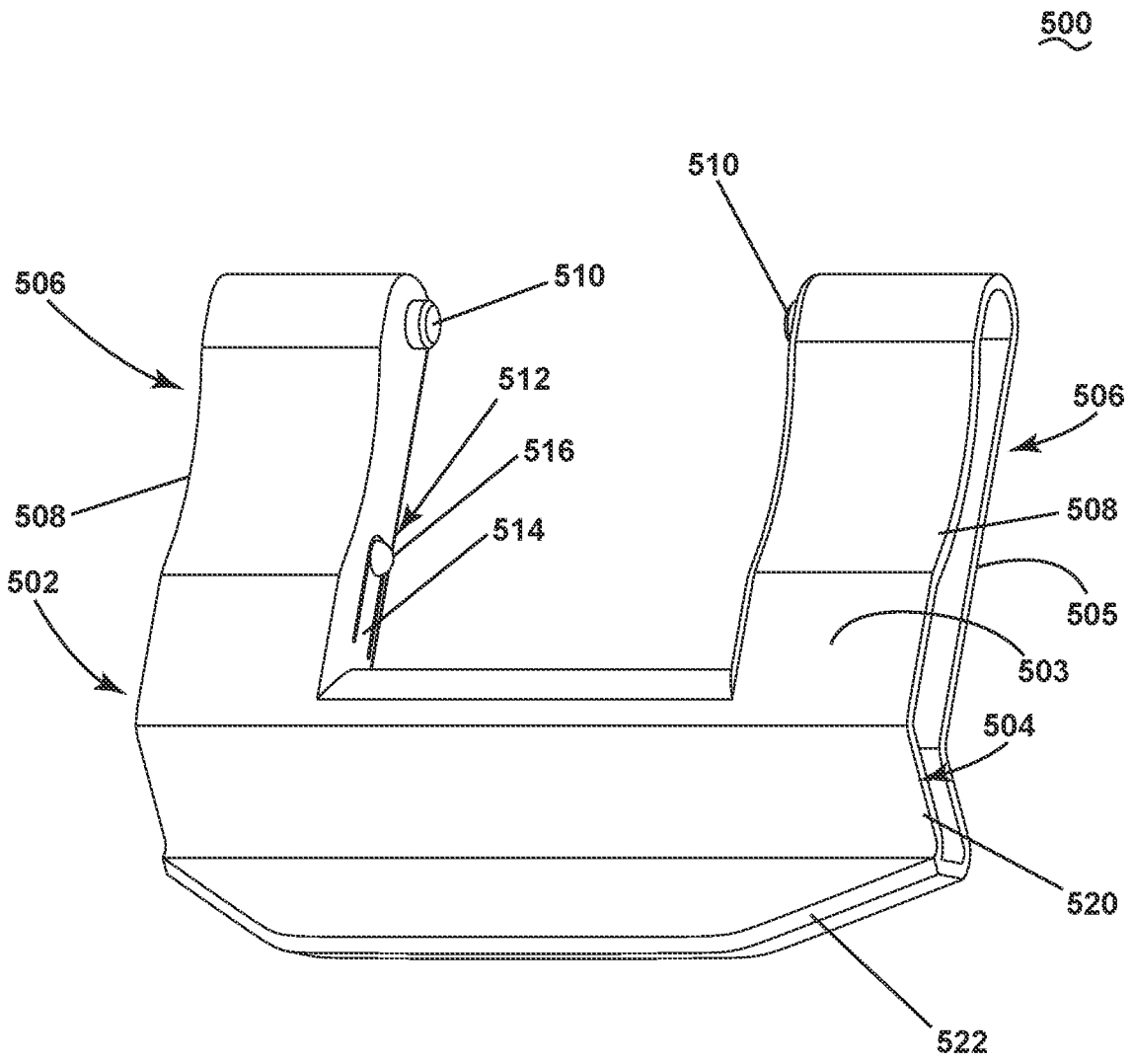
FIG. 13 is a perspective view of yet another exemplary brake assembly that can be utilized in the vacuum cleaner of FIG. 2.

FIG. 13 illustrates another non-limiting example of a brake assembly 500. The brake assembly 500 is similar to the brake assembly 100, 200, 300, 400; therefore, like parts will be identified with like numerals in the 500 series, with it being understood that the description of the like parts of the brake assembly 100, 200, 300, 400 applies to the brake assembly 500 unless otherwise noted.

The brake assembly 500 can include a set of legs 506 without the set of feet 128 of the brake assembly 100. Alternatively, the brake assembly 500 can include the set of feet 128. The brake assembly 500 is a combination of the brake assembly 100, 200 of FIG. 5 and FIG. 10, respectively, and the brake assembly 400 of FIG. 12. As such, the brake assembly 500 includes the set of legs 506, and groove 508 with a larger width similar to the corresponding parts of the brake assembly 400. The brake assembly 500 further includes the handle 504 with a first portion 520 and a second portion 522 similar to the corresponding portions of the brake assembly 100, 200, 400. As such, the brake assembly 500 can be defined as a brake assembly 500 that exerts a larger frictional force on the wheels 58, while also including an ergonomically efficient handle 504.

Figure 14B:
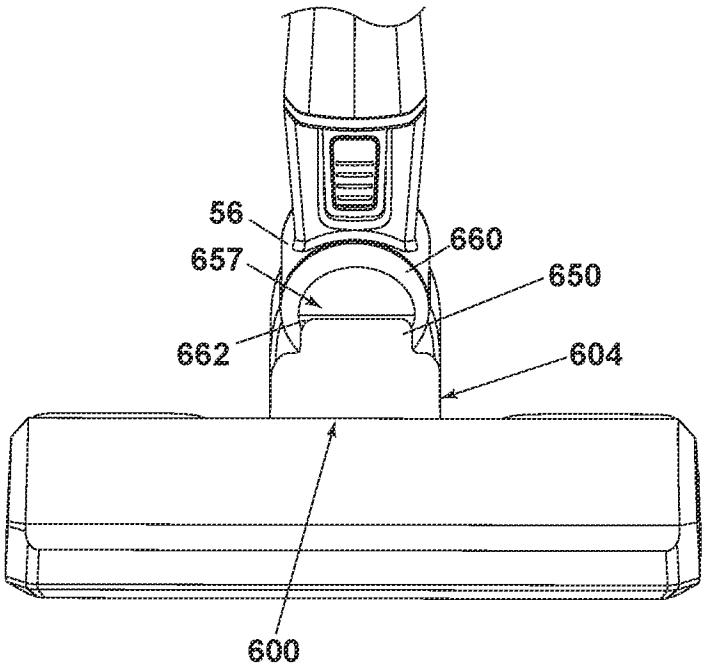
FIG. 14B is a front perspective view of the brake assembly of FIG. 14A with the brake assembly in the first position.
Figure 14A:
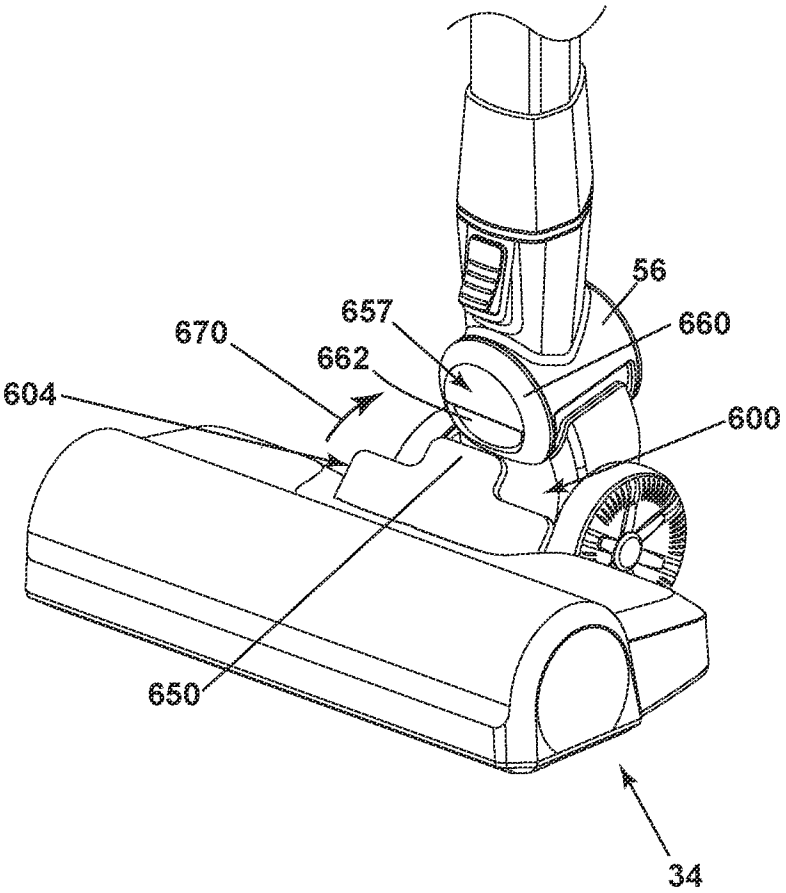
FIG. 14A is a perspective view of yet another exemplary brake assembly that can be utilized in the vacuum cleaner of FIG. 2 with the brake assembly in the second position.

FIGS. 14A-14B illustrate another non-limiting example of a brake assembly 600. The brake assembly 600 is similar to the brake assemblies 100, 200, 300, 400, 500; therefore, like parts will be identified with like numerals in the 600 series, with it being understood that the description of the like parts of the brake assembly 100, 200, 300, 400, 500 applies to the brake assembly 600 unless otherwise noted.

The brake assembly 600 can include a handle 604 that can be similar to the corresponding portions of any of the previously described brake assemblies 100, 200, 300, 400, 500, and can further include a locking portion 650 extending from the handle 604. The locking portion 650 can be positioned on the brake assembly 600 such that, when the brake assembly 600 is in the first or locked position (FIG. 14B), the locking portion 650 extends into an opening 662 at least partially defined by a locking ring 660 provided within the upper portion 56 of the swivel joint assembly 52, and specifically at a front surface 657 of the upper portion 56. In this manner, the locking portion 650 is received within another portion of the vacuum cleaner 10 and selectively retained thereby. It is contemplated that the locking portion 650 can be received and retained within any suitable portion, including a portion of the swivel joint 52 or a portion of the upright assembly 32. In the illustrated example, and by way of non-limiting example, the locking ring 660 has been provided, which receives and selectively retains the locking portion 650 within the opening 662 via friction fit.

In the unlocked position of FIG. 14A, the locking portion 650 is not received within the locking ring 660. In operation, when the brake assembly 600 is moved from the second or unlocked position (FIG. 14A) to the first, locked position (FIG. 14B), in the direction illustrated by the arrow 670, the brake assembly 600 contacts at least one of the wheels 58 to prevent rotation of the at least one wheel 58, as described previously with respect to the brake assembly 100, and simultaneously, the locking portion 650 of the brake assembly 600 is received within the locking ring 660. In the illustrated example, the locking portion 650 protrudes into the opening 662 at the center of the locking ring 660 of the upper portion 56. The locking portion 650 being retained within the opening 662 of the locking ring 660 prevents the lateral or side-to-side rotation between the wand 40 and the base assembly 34. Thus, when the brake assembly 600 includes the locking portion 650, movement of the brake assembly 600 into the locking position prevents rotation of the wheels 58 while also preventing side-to-side swivel of the wand 40 relative to the base assembly 34, which prevents the vacuum cleaner 10 from tipping over. Thus, the brake assembly 600 can prevent the wand 40 from moving and tipping over the vacuum cleaner 10 when it is in a resting or non-use position, which can occur when the wand 40 tilts too far to one side or the other, causing the vacuum cleaner 10 to fall to the side.

To release the vacuum cleaner 10 from the locked position (FIG. 14B), the brake assembly 600 is moved from the first, locked position (FIG. 14B) to the second, unlocked position (FIG. 14A), which moves the brake assembly 600 out of contact with the at least one of the wheels 58 to allow rotation of the at least one wheel 58 and also removes the locking portion 650 of the brake assembly 600 from the opening 662 of the locking ring 660, allowing side-to-side swivel of the wand 40 relative to the base assembly 34.

Figure 15:
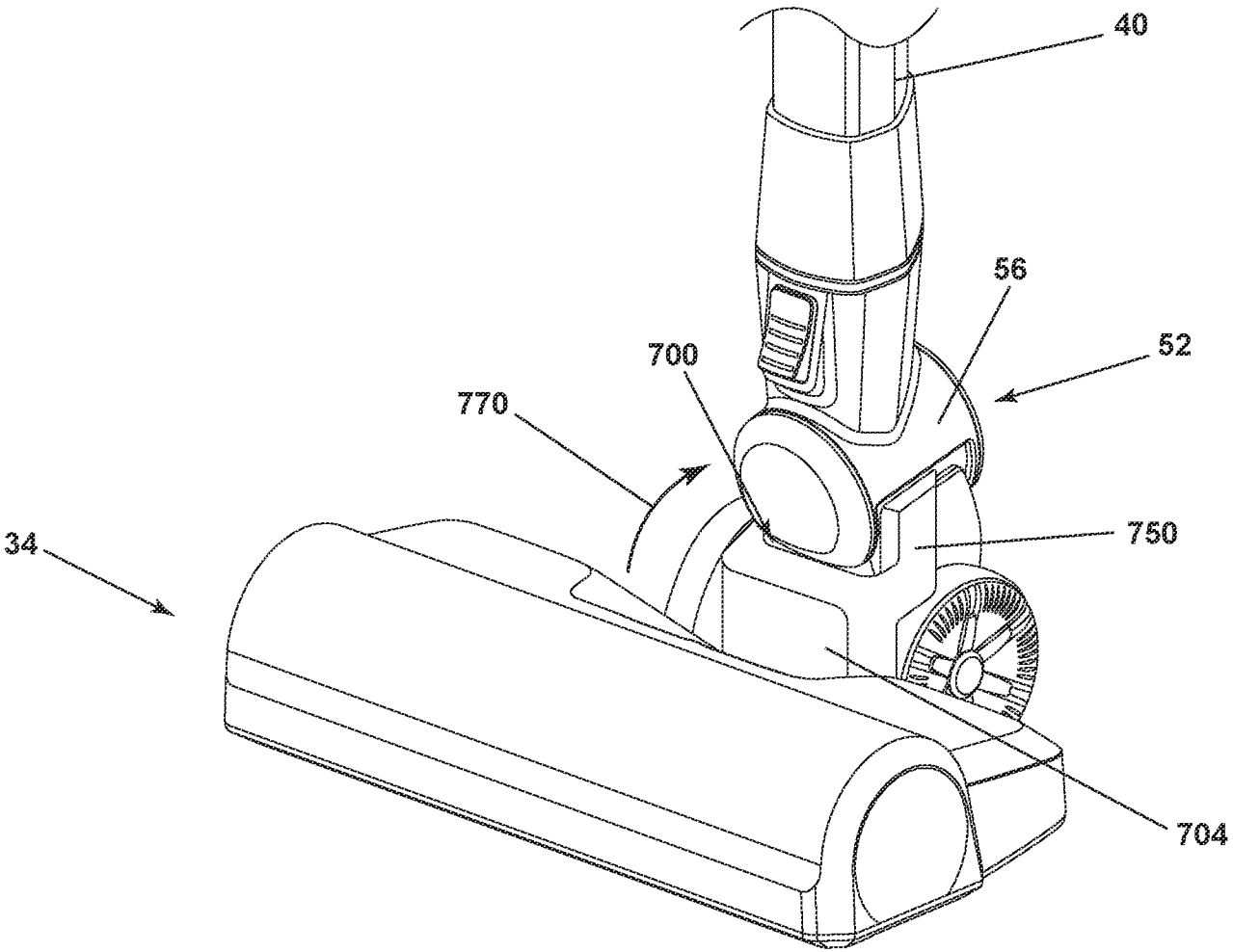
FIG. 15 is a perspective view of yet another exemplary brake assembly that can be utilized in the vacuum cleaner of FIG. 2 with the brake assembly in the first position.

FIG. 15 illustrates another non-limiting example of a brake assembly 700. The brake assembly 700 is similar to the brake assemblies 100, 200, 300, 400, 500, 600; therefore, like parts will be identified with like numerals in the 700 series, with it being understood that the description of the like parts of the brake assembly 100, 200, 300, 400, 500, 600 applies to the brake assembly 700 unless otherwise noted.

The brake assembly 700 can include the handle 704 that can be similar to the corresponding portions of any of the previously described brake assemblies 100, 200, 300, 400, 500, 600, and can further include the locking portion 750 extending from the handle 704, similar to the locking portion 650. While the locking portion 650 was illustrated as a single locking portion 650 extending from a center portion of the handle 604, the locking portion 750 of the brake assembly 700 can comprise a pair of opposing locking portions 750. The locking portions 750 can be positioned on the brake assembly 700 such that, when the brake assembly 700 is in the first or locked position as shown, the locking portions 750 extend along at least a portion of the sides of the upper portion 56 of the swivel joint assembly 52.

In operation, when the brake assembly 700 is moved from the second or unlocked position (not shown) to the first, locked position of FIG. 15, in the direction illustrated by the arrow 770, the brake assembly 700 contacts at least one of the wheels 58 to prevent rotation of the at least one wheel 58, as described previously with respect to the brake assembly 100, and simultaneously, the locking portions 750 of the brake assembly 700 are moved to protrude along the opposing sides of the upper portion 56, which prevents the lateral or side-to-side rotation between the wand 40 and the base assembly 34. Thus, when the brake assembly 700 includes the locking portions 750, movement of the brake assembly 700 into the locking position prevents rotation of the wheels 58 while also preventing side-to-side swivel of the wand 40 relative to the base assembly 34, which prevents the vacuum cleaner 10 from tipping over. Thus, the brake assembly 700 can prevent the wand 40 from moving and tipping over the vacuum cleaner 10 when it is in a resting or non-use position, which can occur when the wand 40 tilts too far to one side or the other, causing the vacuum cleaner 10 to fall to the side. In this respect, the brake assembly 700 is similar to the brake assembly 600, but the brake assembly 700 does not require that the locking ring 660 of the upper portion 56 has the opening 662, as is required to receive the locking portion 650 of the brake assembly 600.

To release the vacuum cleaner 10 from the locked position as shown, the brake assembly 700 is moved from the first, locked position to the second, unlocked position, which moves the brake assembly 700 out of contact with the at least one of the wheels 58 to allow rotation of the at least one wheel 58 and also removes the locking portions 750 of the brake assembly 700 from along the opposing sides of the upper portion 56, allowing side-to-side swivel of the wand 40 relative to the base assembly 34.

Figure 16B:
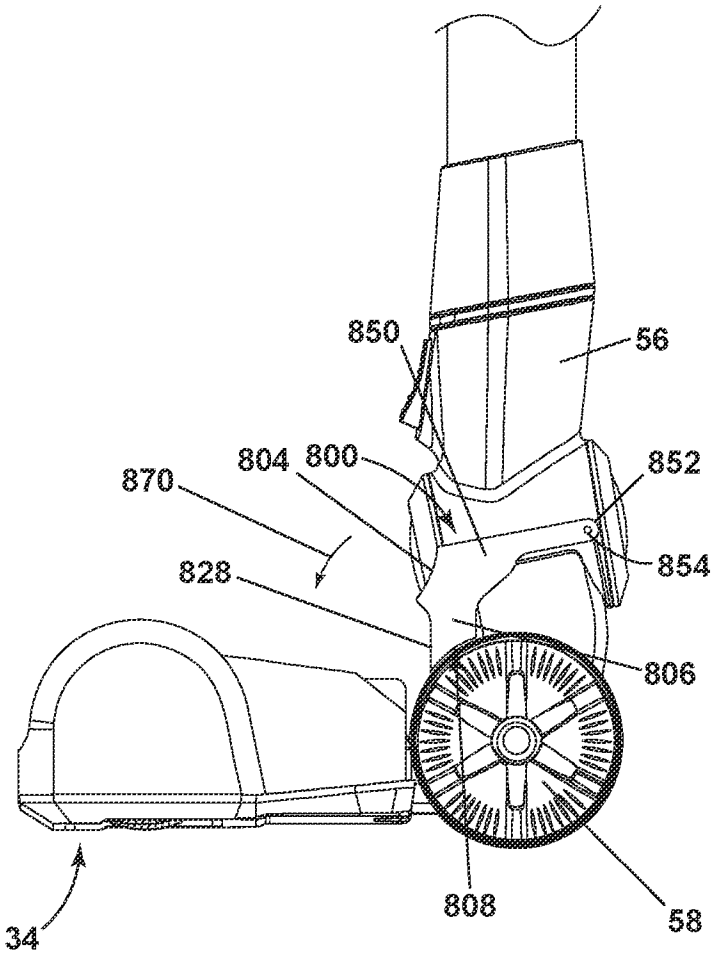
FIG. 16B is a side view of the brake assembly of FIG. 16A.
Figure 16A:
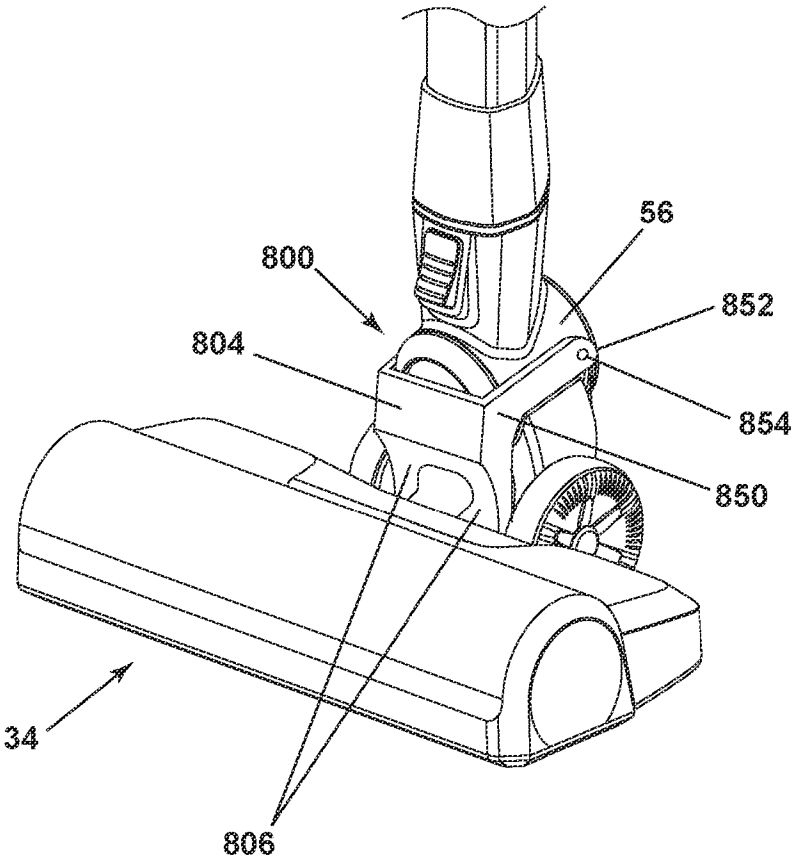
FIG. 16A is a perspective view of yet another exemplary brake assembly that can be utilized in the vacuum cleaner of FIG. 2 with the brake assembly in the first position.

FIGS. 16A-16B illustrate another non-limiting example of a brake assembly 800. The brake assembly 800 is similar to the brake assemblies 100, 200, 300, 400, 500, 600, 700; therefore, like parts will be identified with like numerals in the 800 series, with it being understood that the description of the like parts of the brake assembly 100, 200, 300, 400, 500, 600, 700 applies to the brake assembly 800 unless otherwise noted.

The brake assembly 800 can have a structure similar to that of the brake assembly 700 in that the brake assembly 800 includes the pair of opposing, spaced apart locking portions 850, but with a configuration with respect to the upper portion 56 and to the base assembly 34 that differs from that of the brake assembly 700. For example, rather than being rotatably coupled with the base assembly 34 as in the case of the previously described brake assemblies 100, 200, 300, 400, 500, 600, 700, the brake assembly 800 can instead be rotatably coupled with the upper portion 56 and/or with at least a portion of the swivel joint assembly 52. Specifically, the locking portions 850 can extend from the handle 804 along the sides of the upper portion 56 to distal ends 852 of the locking portions 850 that are furthest from the handle 804, with the distal ends 852 coupled to the upper portion 56 for rotation relative to the upper portion 56 about an axis of rotation 854 defined by the distal ends 852. The brake assembly 800 can further still include two legs 806 spaced by the handle 804 each including the foot 828. The brake assembly 800 further includes the set of grooves 808 confronting or contacting the wheels 58, but the grooves 808 are provided at the ends of the feet 828, rather than along a side of the legs 806.

In operation, the function of the brake assembly 800 remains similar to that of the brake assembly 700. As the brake assembly 800 is moved from the second or unlocked position (not shown) to the first, locked position of FIGS. 16A-16B, in the direction of the arrow 870 as shown in FIG. 16B, the brake assembly 800 rotates downwardly about the axis of rotation 854 defined by the distal ends 852 until the grooves 808 of the feet 828 contact at least one of the wheels 58 to prevent rotation of the at least one wheel 58, as described previously with respect to the brake assembly 100, and simultaneously, the locking portions 850 of the brake assembly 800 are moved downwardly into position alongside the sides of the upper portion 56, which prevents the lateral or side-to-side rotation between the wand 40 and the base assembly 34. Thus, when the brake assembly 800 includes the locking portions 850, movement of the brake assembly 800 into the locking position prevents rotation of the wheels 58 while also preventing side-to-side swivel of the wand 40 relative to the base assembly 34, which prevents the vacuum cleaner 10 from tipping over. Thus, the brake assembly 800 can prevent the wand 40 from moving and tipping over the vacuum cleaner 10 when it is in a resting or non-use position, which can occur when the wand 40 tilts too far to one side or the other, causing the vacuum cleaner 10 to fall to the side.

To release the vacuum cleaner 10 from the locked position as shown, the brake assembly 800 is moved from the first, locked position to the second, unlocked position, which moves the brake assembly 800, specifically the feet 828 and the grooves 808, out of contact with the at least one of the wheels 58 to allow rotation of the at least one wheel 58, and also removes the locking portions 850 of the brake assembly 800 from along the sides of the upper portion 56, allowing side-to-side swivel of the wand 40 relative to the base assembly 34.

The brake assemblies 600, 700, 800 as described in FIGS. 14-16 are provided as brake assemblies 600, 700, 800 that, when in the first, locked position, both prevent rotation of the wheels 58 such that the vacuum cleaner 10 can be stood upright, and remain upright, and also prevent lateral or side-to-side rotation between the wand 40 and base assembly 34 to further ensure that the vacuum cleaner 10 can be stood upright, and remain upright, by preventing the vacuum cleaner 10 from falling to the side. Furthermore, the vacuum cleaner 10 including any of the brake assemblies 600, 700, 800 can also include other components to ensure that the vacuum cleaner 10 remains in the upright position, non-limiting examples of which can include providing the vacuum cleaner 10 with magnets, detent structures, or counterweights that can serve to bias or retain the vacuum cleaner 10 in the upright position, corresponding to the locked position of the brake assemblies 600, 700, 800. The inclusion of such biasing features can ensure that the vacuum cleaner 10 remains upright and is kept from falling over, such as even when the hand-held portion 36 is removed for use, leaving the wand 40 and the base assembly 34 in the upright or storage position.

The vacuum cleaner 10 can further include a support assembly for use in positioning or retaining the vacuum cleaner 10 in the storage position when the vacuum cleaner 10, or at least the base assembly 34 and wand 40, is not in use. The storage position can include, but is not limited to, an upright or semi-upright position wherein the vacuum cleaner 10 can be leaned against a surface or other object, suspended from or resting on a surface or other object, or can be provided in a self-supporting stand-alone upright configuration.

Figure 17:
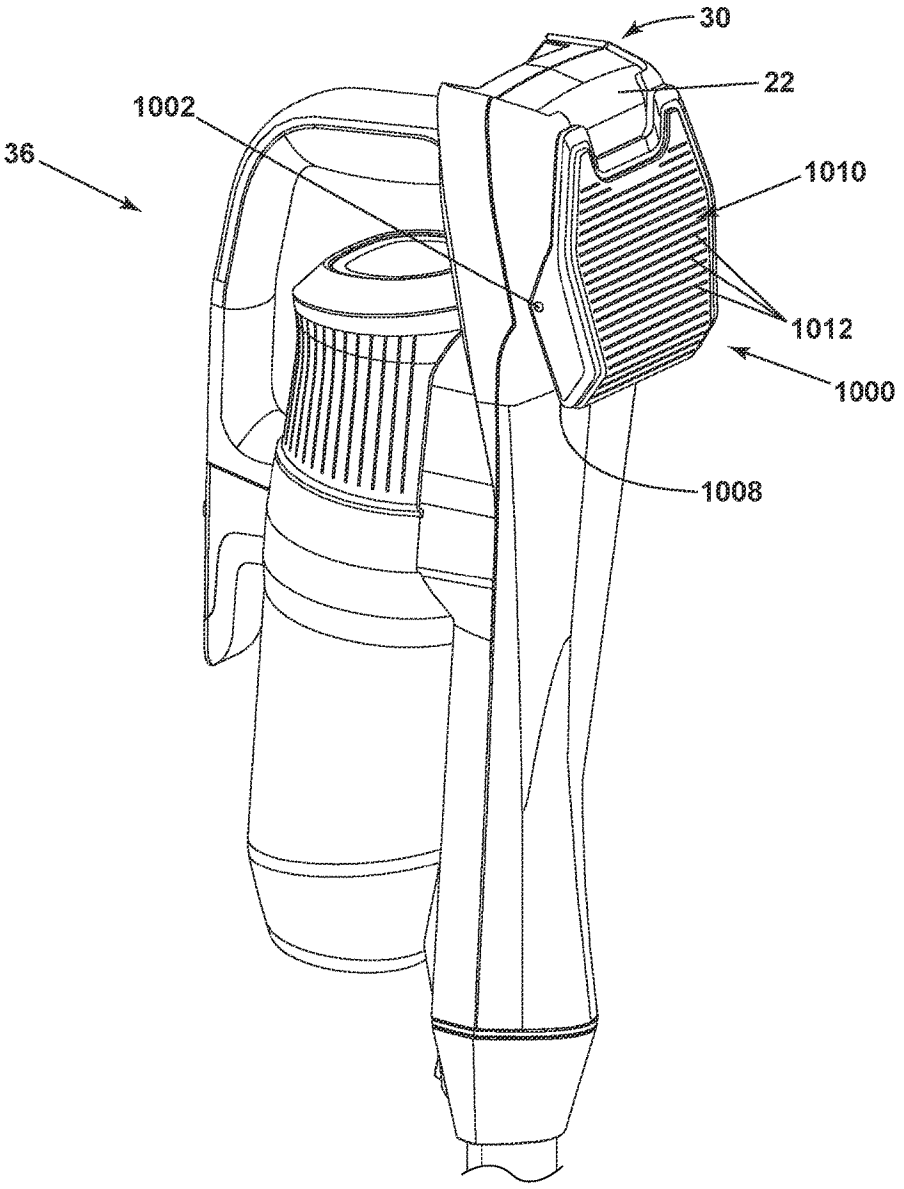
FIG. 17 is a perspective view of an exemplary gripping assembly that can be utilized in the vacuum cleaner of FIG. 2.

FIG. 17 illustrates an example of such a support assembly, provided herein as a gripping assembly 1000, provided on the hand-held portion 36. The gripping assembly 1000 is shown as being provided on a rear surface of the power source 22, though it will be understood that the gripping assembly 1000 can be provided at any suitable position of the housing 30. The gripping assembly 1000 is movably coupled to the hand-held portion 36, such that the gripping assembly 1000 can pivot relative to the hand-held portion 36 about an axis of rotation 1002 such that the gripping assembly 1000 can rotate to accommodate the angle of the surface or object against which the vacuum cleaner 10 is leaned. The gripping assembly 1000 further comprises a gripping surface 1010 configured to provide traction against a surface or object against which the gripping assembly 1000 can be leaned. Non-limiting examples of such a suitable gripping surface 1010 include a surface that is textured, such as by including ribs 1012 or ridges to increase traction, or a gripping surface 1010, whether textured or flat, that is formed from a material with suitable surface adhesion properties, such as rubber or foam. It will be understood that the textured surface can have any suitable profile or surface texture.

Figure 18B:
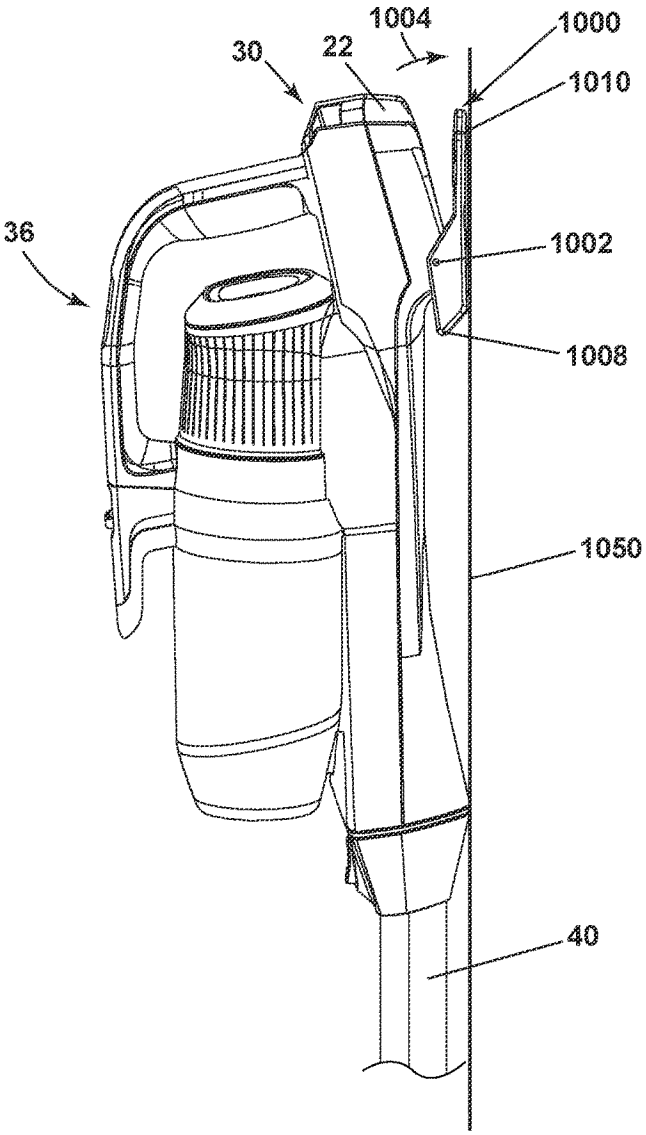
FIG. 18B is a side view of the gripping assembly of FIG. 17 with the gripping assembly in a rotated position.
Figure 18A:
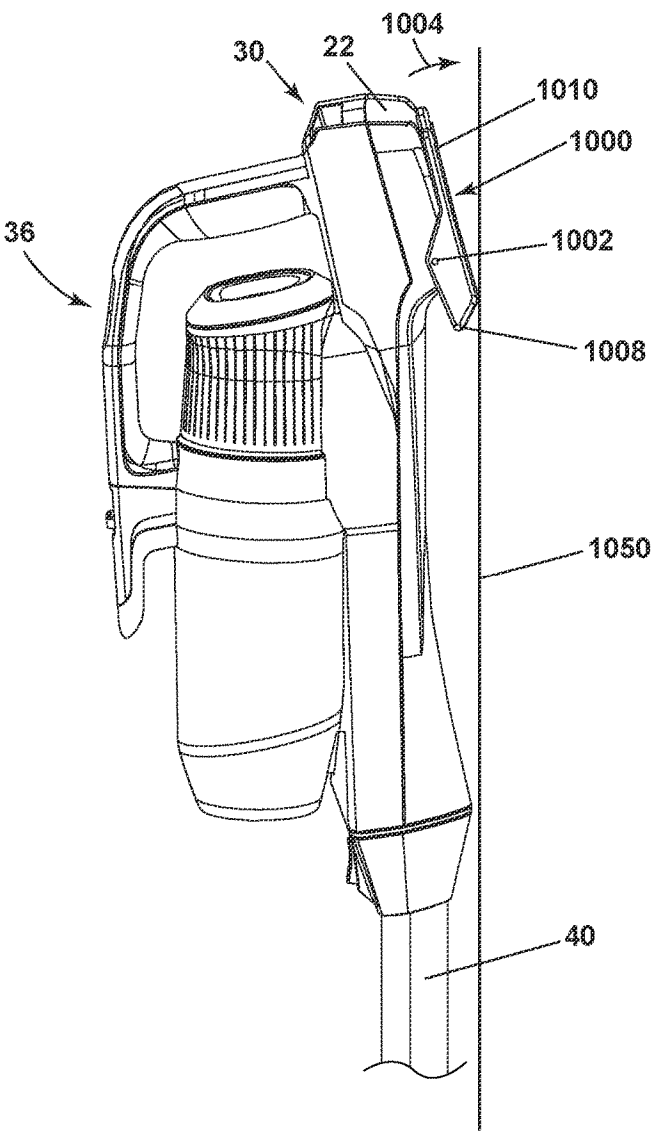
FIG. 18A is a side view of the gripping assembly of FIG. 17 with the gripping assembly in a non-rotated position.
Figure 18C:
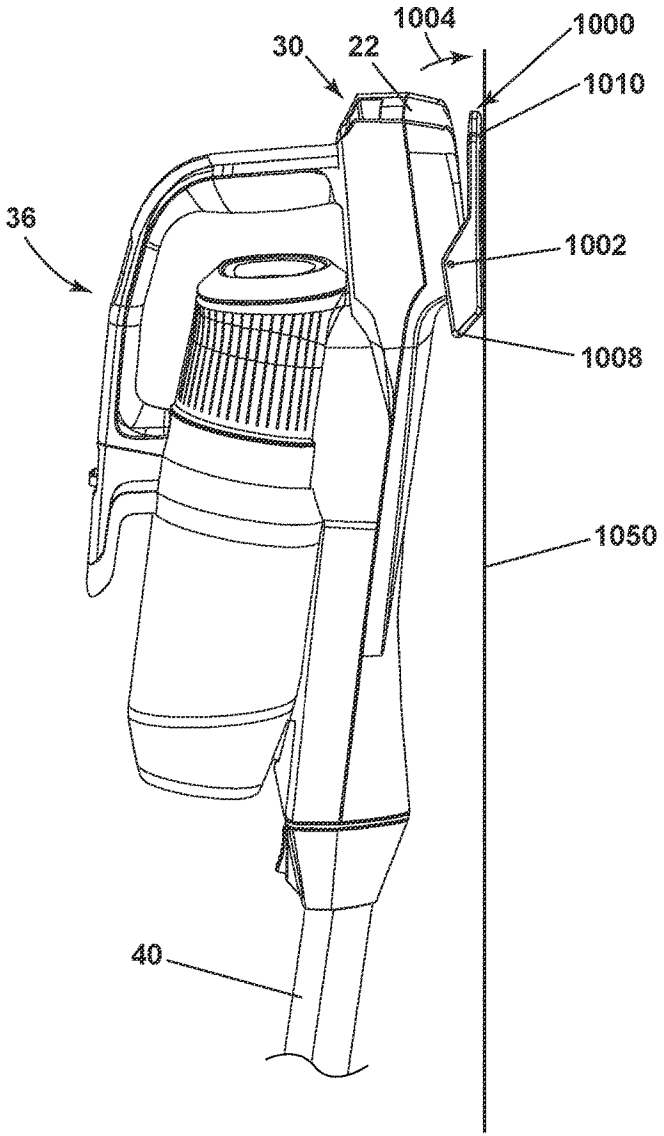
FIG. 18C is a side view of the gripping assembly of FIG. 17 with the gripping assembly in another rotated position.

Turning now to FIGS. 18A-18C, the gripping assembly 1000 is illustrated when the vacuum cleaner 10 is leaned against a surface 1050, illustrated herein as a wall 1050. As indicated by the arrow 1004, as the vacuum cleaner 10 is leaned against the wall 1050, the gripping assembly 1000 comes into contact with the wall 1050 surface and rotates from an initial, non-rotated position (FIG. 18A) about the axis of rotation 1002 until the gripping surface 1010 is aligned with the wall 1050 and in contact with the wall 1050 to define at least one rotated position (FIG. 18B, FIG. 18C). It will be understood that such rotation of the gripping assembly 1000 from the initial, non-rotated position to the rotated positions wherein the gripping surface 1010 is aligned with and in contact with the wall 1050 can be effected by the weight and force of the vacuum cleaner 10 and/or of the hand-held portion 36 itself as the gripping assembly 1000 is leaned against the wall 1050, and/or the gripping assembly 1000 can be manually moved by a user from the initial, non-rotated position to the rotated positions, either prior to or as the gripping assembly 1000 is being brought into contact with the wall 1050. The contact between the gripping surface 1010 and the wall 1050 then serves to maintain the vacuum cleaner 10 in the storage position and to reduce the likelihood that the vacuum cleaner 10 may slide along the wall 1050, in at least one of vertical movement and/or lateral movement relative to the surface or wall 1050, to fall down or fall over, even at a variety of angles between the vacuum cleaner 10 and the wall 1050. By way of non-limiting example, the views of FIG. 18B and FIG. 18C illustrate the vacuum cleaner 10 leaned against the wall 1050 at differing angles, with the degree of rotation of the gripping assembly 1000 about the axis of rotation 1002 accommodating the differing angles of the vacuum cleaner 10 while maintaining the gripping surface 1010 aligned with and in contact with the wall 1050. Thus, the rotatability of the gripping assembly 1000 allows for a user to be able to quickly lean the vacuum cleaner 10 against a surface 1050 without having to carefully rest the vacuum cleaner 10 against the surface 1050 at a particular angle, as the gripping assembly 1000 will rotate such that the gripping surface 1010 meets the wall 1050 whether the vacuum cleaner 10 is positioned nearly upright (FIG. 18B) or at an increased angle (FIG. 18C) with respect to the wall 1050.

Figure 19:
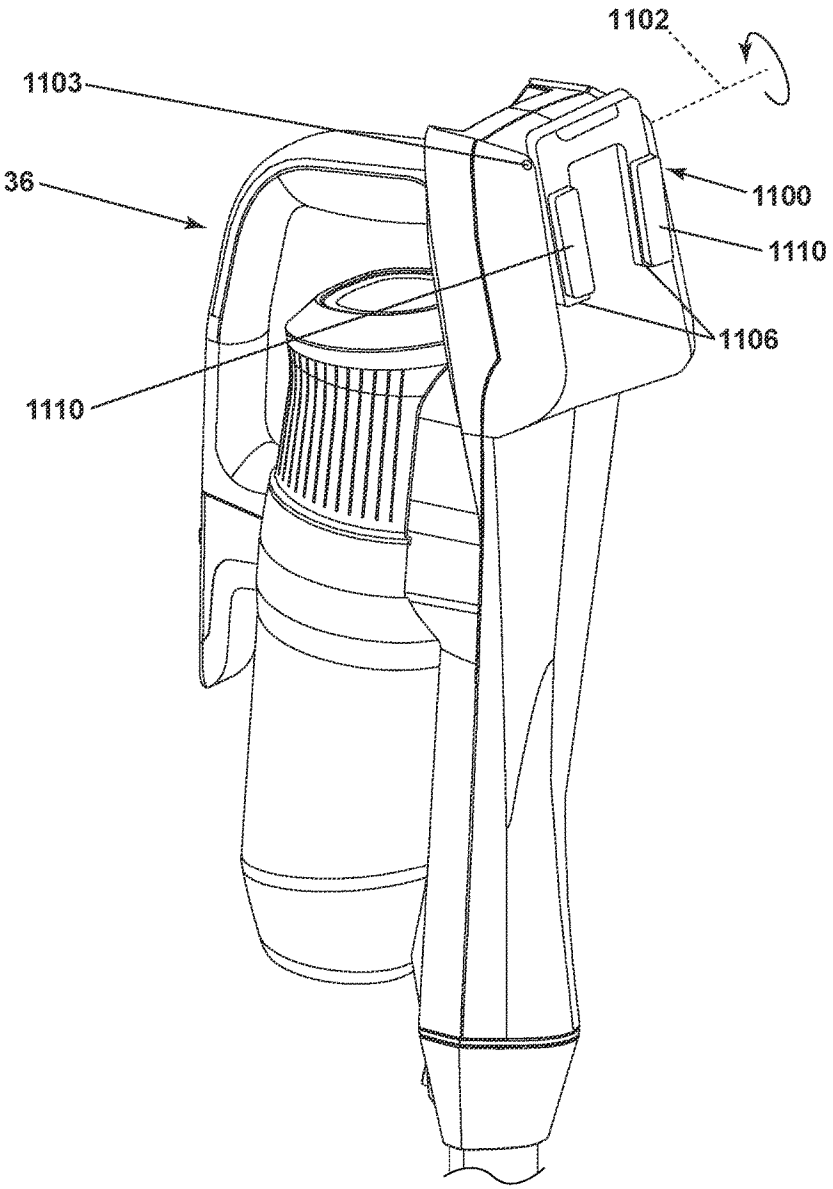
FIG. 19 is a perspective view of another exemplary gripping assembly that can be utilized in the vacuum cleaner of FIG. 2.
Figure 20B:
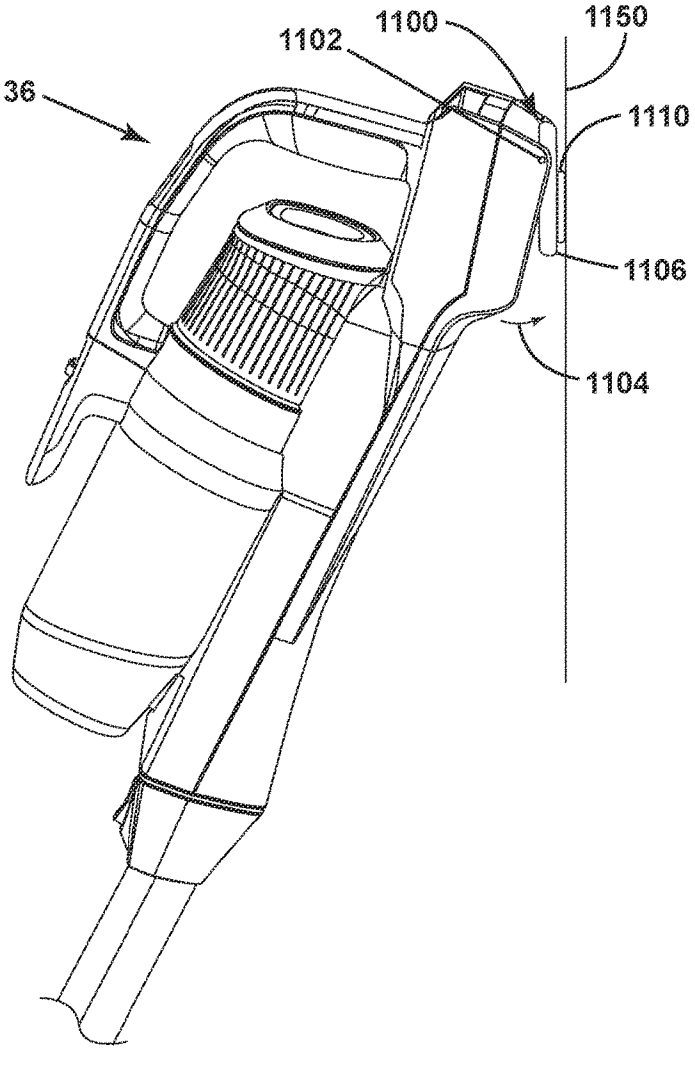
FIG. 20B is a side view of the gripping assembly of FIG. 19 with the gripping assembly in a rotated position.
Figure 20A:
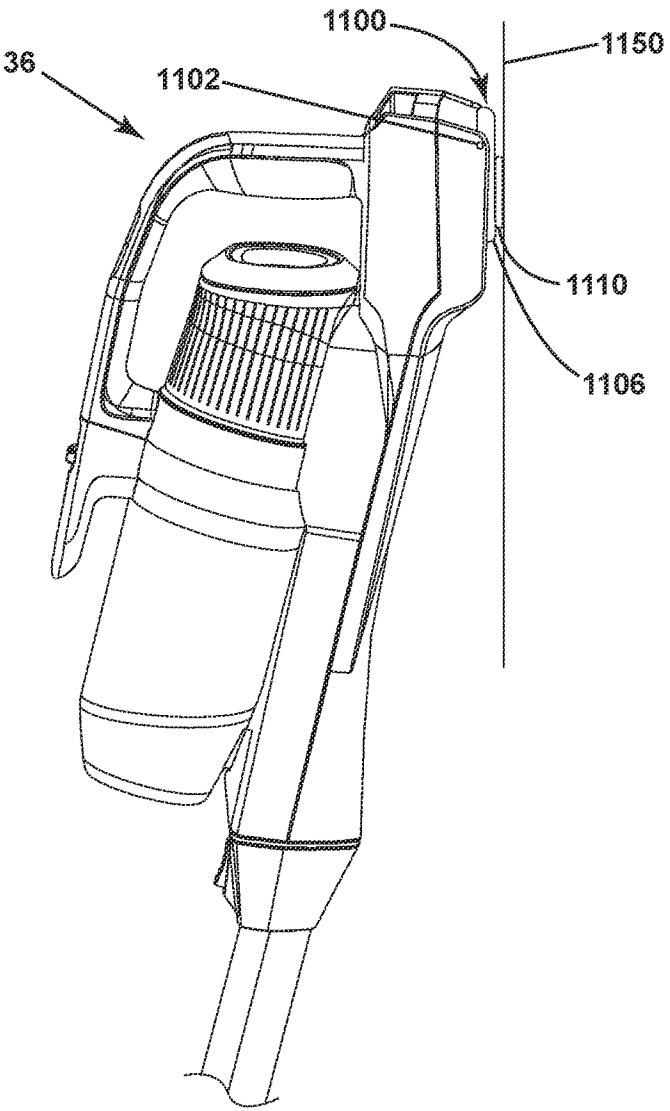
FIG. 20A is a side view of the gripping assembly of FIG. 19 with the gripping assembly in a non-rotated position.

FIGS. 19, 20A, and 20B illustrate another non-limiting example of a gripping assembly 1100 that can be used with the vacuum cleaner 10. The gripping assembly 1100 is similar to the gripping assembly 1000; therefore, like parts will be identified with like numerals in the 1100 series, with it being understood that the description of the like parts of the gripping assembly 1000 applies to the gripping assembly 1100 unless otherwise noted.

The gripping assembly 1100 can include the axis of rotation 1102 about which the gripping assembly 1100 can rotate. In one non-limiting example, the axis of rotation 1102 can include a cam 1103 defining the axis of rotation 1102 about which the gripping assembly 1100 is rotatable. The gripping assembly 1100 further includes the gripping surface 1110. By way of non-limiting example, the gripping surface 1110 of the gripping assembly 1100 can be provided as a pair of legs 1106 extending separately downward from the axis of rotation 1102, such as to form an inverted U-shape, and carrying gripping surfaces 1110. As described previously with respect to the gripping surface 1010, the gripping surfaces 1110 are configured to provide traction against a surface 1150 or object against which the gripping assembly 1100 can be leaned. Non-limiting examples of such suitable gripping surfaces 1110 include a surface that is textured, such as by including ribs or ridges to increase traction, or gripping surfaces 1110, whether textured or flat, that is formed from a material with suitable surface adhesion properties, such as rubber or foam. It will be understood that the textured surface can have any suitable profile or surface texture.

In operation, the gripping assembly 1100 rotates, as previously described with respect to the gripping assembly 1000, from an initial, non-rotated position (FIG. 20A) about the axis of rotation 1102, and in the direction as illustrated by the arrow 1104 (FIG. 20B) as it is brought into contact with the surface 1150 such that the gripping surface 1110 conforms to the angle of the surface 1150 to define a rotated position (FIG. 20B) and to provide a stable contact between the gripping surface 1110 and the wall 1150 for supporting the vacuum cleaner 10. Further, the relative positioning of the gripping assembly 1100, the axis of rotation 1102, and the upper extent of the hand-held portion 36 are provided such that the legs 1106 of the gripping assembly 1100 can also be rotated away from the hand-held portion 36 enough that the legs 1106 can be latched over an object, such as a chair back or a railing, to support the vacuum cleaner 10 when it is not convenient to lean the gripping assembly 1100 against an upright surface 1150.

Further, either of the gripping assemblies 1000, 1100 can be used to support the vacuum cleaner 10 against or on a variety of surfaces. By way of non-limiting example, either of the gripping assemblies 1000, 1100 can be rotated such that a lower portion 1008 (FIG. 17) or the legs 1106 of the gripping assembly 1000, 1100 are rotated away from the hand-held portion 36 enough that the lower portion 1008 or the legs 1106 can be latched over or upon an object, such as to stabilize on a surface, such as a counter, or to hook over a door handle, the back of a piece of furniture, such as a chair or a sofa, or over a dock for the vacuum cleaner 10, such as a post (not shown) defining an upper surface or a pocket or channel into which the lower portion 1008 or the legs 1106 of the gripping assembly 1000, 1100 can be received. In the case that a dock for the vacuum cleaner 10 is provided for interaction with the gripping assembly 1000, 1100, the dock can also serve as a charging station such that the hand-held portion 36 is moved into engagement with a charger when the gripping assembly 1000, 1100 is supported by the dock. In the case that the lower portion 1008 or the legs 1106 of the gripping assembly 1000, 1100 are rotated away from the hand-held portion 36 so as to stabilize the vacuum cleaner 10 on a generally flat surface, such as a table or a countertop, the bottom surface of the lower portion 1008 or of the legs 1106 can abut or rest on the substantially horizontal surface to create a gripping contact or a friction hold in order to support the vacuum cleaner 10. Further, such a rotating movement to move the lower portion 1008 or the legs 1106 of the gripping assemblies 1000, 1100 away from the hand-held portion 36 can be achieved by a user manually rotating the gripping assembly 1000, 1100, or by the use of a button or an actuator (not shown), such as a slide, that a user can actuate to effect the rotation.

Figure 21:
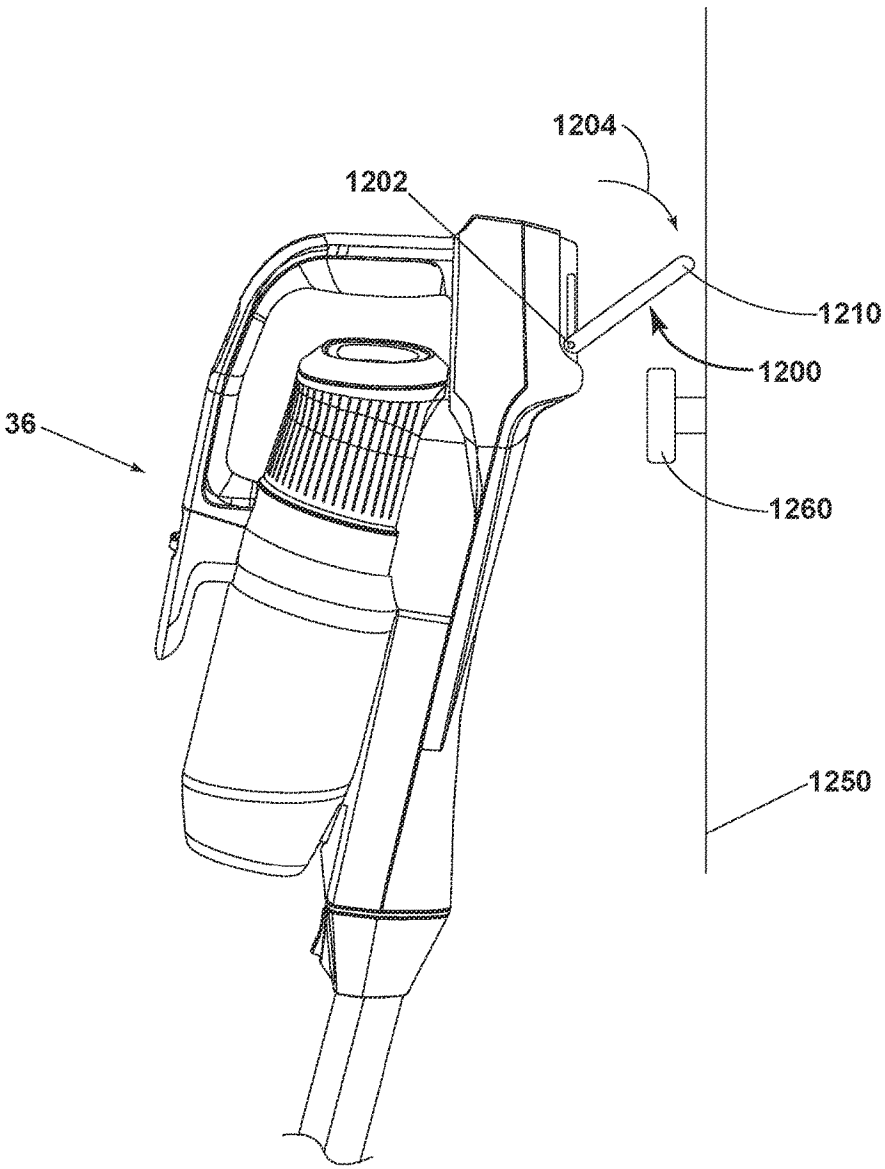
FIG. 21 is a side view of yet another exemplary gripping assembly that can be utilized in the vacuum cleaner of FIG. 2 with the gripping assembly in a rotated position.

FIG. 21 illustrates another non-limiting example of a gripping assembly 1200 that can be used with the vacuum cleaner 10. The gripping assembly 1200 is similar to the gripping assemblies 1000, 1100; therefore, like parts will be identified with like numerals in the 1200 series, with it being understood that the description of the like parts of the gripping assemblies 1000, 1100 applies to the gripping assembly 1200 unless otherwise noted.

The gripping assembly 1200 can include the axis of rotation 1202 about which the gripping assembly 1200 can rotate. Rather than the gripping assemblies 1000, 1100 rotating to meet the surface 1050, 1150 against which they are leaned, the gripping assembly 1200 can include a gripping surface 1210 that is provided as a loop, hook, or latch that can pivot from an initial, non-rotated position (not shown) away from the hand-held portion 36 about the axis of rotation 1202 in the direction as illustrated by the arrow 1204 and into a rotated, use position as shown to hook over an object, such as a doorknob 1260 extending from a wall 1250, to support the vacuum cleaner 10 and to prevent the vacuum cleaner 10 from falling down or falling to one side or the other. In one non-limiting example, the gripping assembly 1200 can be provided with a detent or catch mechanism (not shown) that retains the gripping assembly 1200 in the non-rotated position (not shown) relative to the hand-held portion 36 and that can be actuated by a user in order to release the gripping assembly 1200 to rotate away from the hand-held portion 36 to the use position as shown, where it can be hooked onto an object. Further by way of non-limiting example, the gripping assembly 1200 can be biased toward the use position when it is not retained in the non-rotated position by the detent, latch, or catch mechanism.

Figure 22:
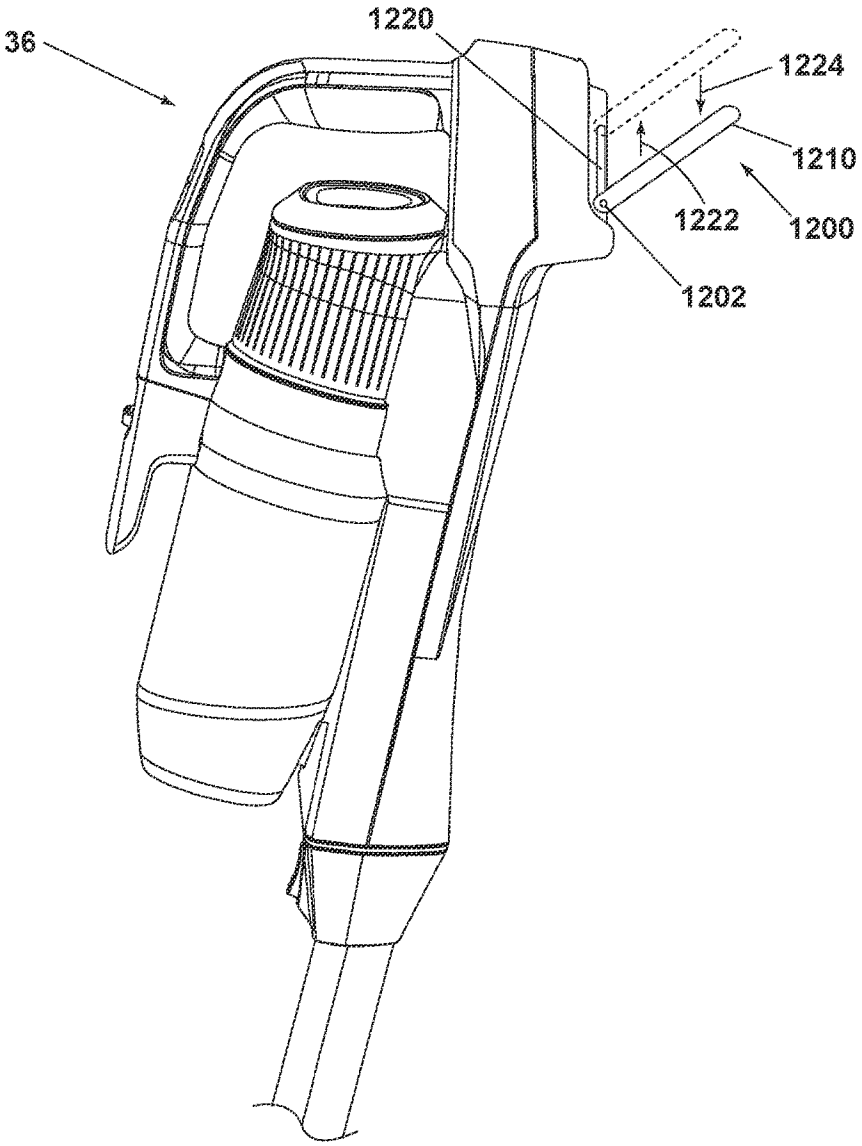
FIG. 22 is an enlarged side view of the gripping assembly of FIG. 21 with the gripping assembly in a rotated and lower position, and showing an alternate rotated and raised position of the gripping assembly.

FIG. 22 illustrates a further optional feature that can be included with the gripping assembly 1200 comprising a slide track 1220 that extends upwardly from the axis of rotation 1202. When the slide track 1220 is included, once the gripping assembly 1200 is moved to the rotated, use position as shown, the gripping assembly 1200 can slide vertically within the slide track 1220, as indicated by the arrows 1222, 1224, to adjust the height of the gripping assembly 1200 in the use position relative to the hand-held portion 36 between the initial lower position, as shown in solid line, and a raised position, as shown in dashed line. This adjustability of the vertical position of the gripping assembly 1200 can allow for the gripping assembly 1200 to accommodate objects, such as doorknobs 1260, of varying height.

Figure 23B:
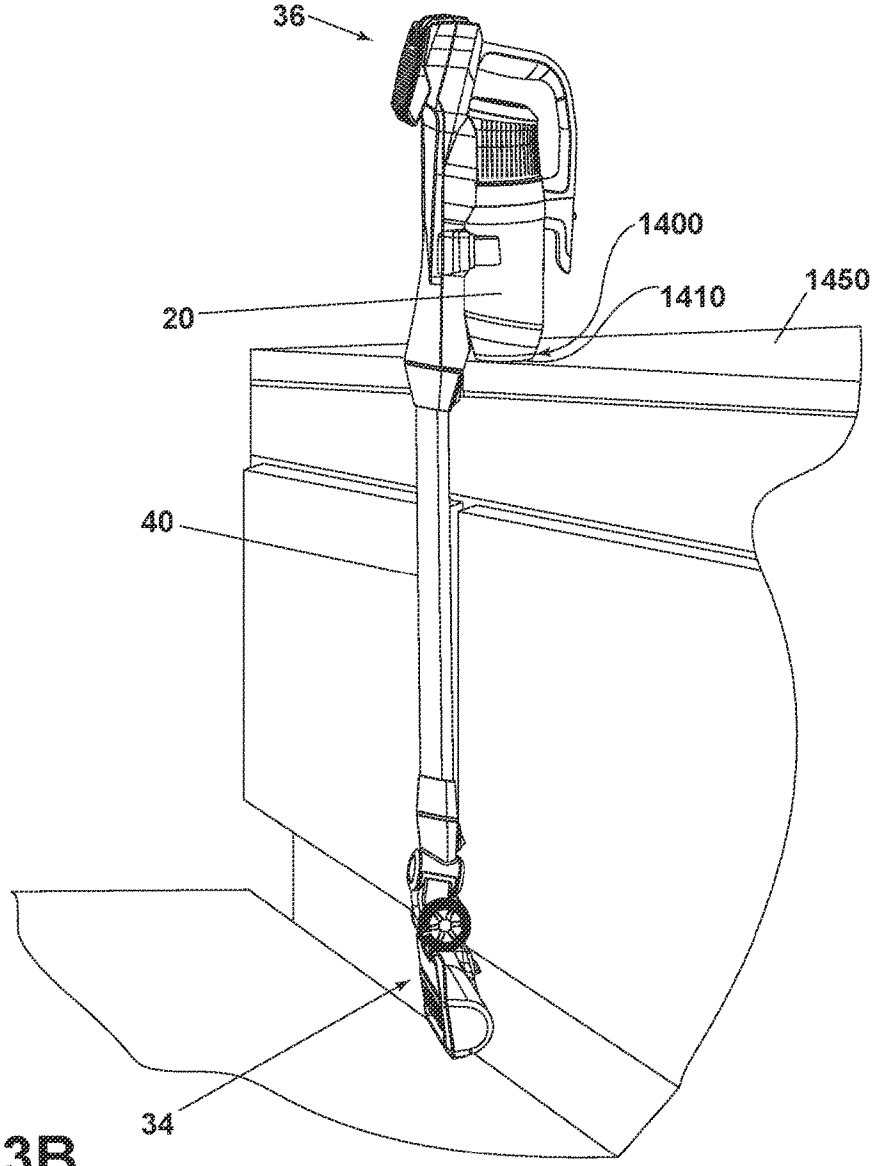
FIG. 23B is a perspective view of the gripping assembly of FIG. 23A with the gripping assembly resting on a surface.
Figure 23A:
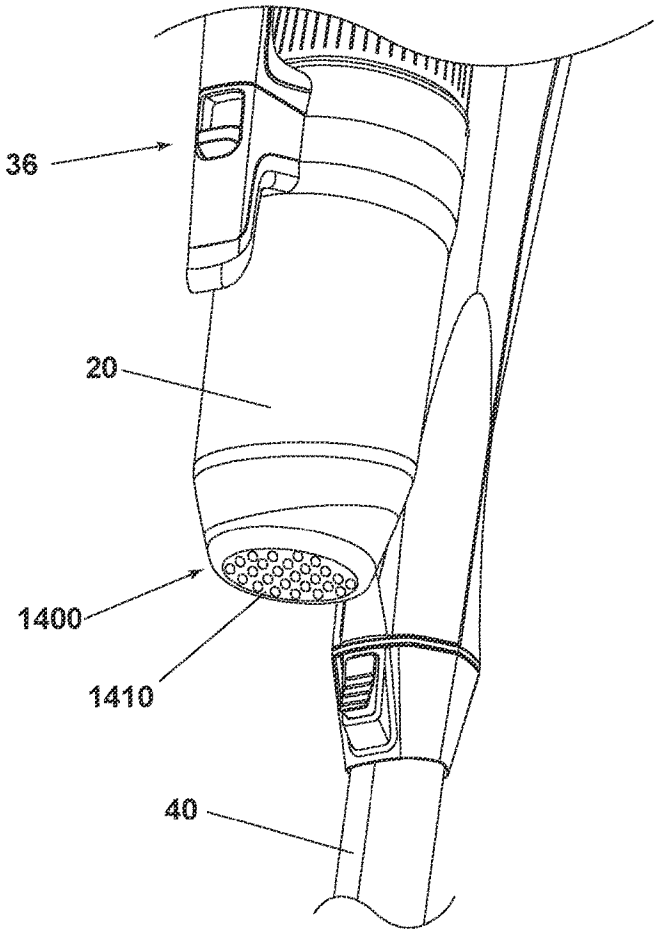
FIG. 23A is a perspective view of yet another exemplary gripping assembly that can be utilized in the vacuum cleaner of FIG. 2.

FIGS. 23A-23B illustrate another non-limiting example of a gripping assembly 1400 that can be used with the vacuum cleaner 10. The gripping assembly 1400 is similar to the gripping assemblies 1000, 1100, 1200; therefore, like parts will be identified with like numerals in the 1400 series, with it being understood that the description of the like parts of the gripping assemblies 1000, 1100, 1200 applies to the gripping assembly 1400 unless otherwise noted.

The gripping assembly 1400, unlike the gripping assemblies 1000, 1100, 1200, is fixed with respect to the hand-held portion 36 and does not include an axis of rotation. Rather, the gripping assembly 1400 simply provides the gripping surface 1410 to the hand-held portion 36 for improved support and grip against the surface 1450 (FIG. 23B) or object against which the gripping assembly 1400 is leaned or rested. As described previously with respect to the gripping surface 1010 of the gripping assembly 1000, the gripping surface 1410 can include a material with high surface adhesion, such as rubber, or a material that is compressible to conform to a surface 1450 or object, such as foam. The gripping assembly 1400 is illustrated herein as including the gripping surface 1410 covering at least the bottom surface of the recovery container 20, though it will be understood that the gripping surface 1410 could be provided on only a portion of the bottom surface of the recovery container 20. By providing at least a portion of the bottom surface of the recovery container 20 with the gripping surface 1410, the recovery container 20 can be used to support the vacuum cleaner 10 in the storage position, as shown in FIG. 23B, such as by resting the recovery container 20 on a generally flat surface 1450, such as a table or a countertop. The gripping properties provided by the gripping surface 1410 ensure that the recovery container 20 is resiliently retained atop the surface 1450 and does not slide off. As described previously with respect to the gripping surfaces 1010, 1110, the gripping surface 1410 is configured to provide traction against the surface 1450 or object against which the gripping assembly 1400 can be leaned and supported. Non-limiting examples of such a suitable gripping surface 1410 include a surface that is textured, such as by including ribs, bumps, detents, protrusions, or ridges to increase traction, or a gripping surface 1410, whether textured or flat, that is formed from a material with suitable surface adhesion properties, such as rubber or foam. It will be understood that the textured surface can have any suitable profile or surface texture.

Various other non-limiting examples of gripping assemblies can be provided with the vacuum cleaner 10, including various non-limiting examples of gripping assemblies that are fixed with respect to the hand-held portion 36 and do not include an axis of rotation. Such gripping assemblies can instead simply provide a gripping surface to the hand-held portion 36 for improved support and grip against a surface or object against which such a gripping assembly is leaned or rested. As described previously with respect to the gripping surfaces 1010, 1110, 1410 of the gripping assemblies 1000, 1100, 1400, such a gripping surface can include a material with high surface adhesion, such as rubber, or a material that is compressible to conform to a surface or object, such as foam.

Non-limiting examples of such gripping assemblies can include a single gripping surface extending along or across at least a portion of a rear surface of the hand-held portion 36, a gripping surface provided as two separate, but co-extensive, strips along at least a portion of the rear surface of the hand-held portion 36, or a gripping surface provided as a compressible portion provided at any suitable location to compress against the surface against which the gripping assembly is leaned to conform to and grip the surface in order to accommodate a variety of angles and surface shapes and still provide improved support and grip for the vacuum cleaner 10 being leaned against a variety of surfaces or objects. A further non-limiting example of such a gripping assembly can include a gripping surface covering all or a portion of a bottom surface of the hand grip 66, which can have an angled geometry to promote a stable grip against a supporting surface, such that the hand grip 66 rests or hooks on a surface, such as a table, a countertop, a chair back, or a railing, to support the vacuum cleaner 10 in the storage position, with the gripping properties of the gripping surface ensuring that the hand grip 66 is resiliently retained atop the surface and does not slip or slide off. A further yet non-limiting example of such a gripping assembly can include a gripping surface covering all or a portion of a rear surface of a collar provided on the wand 40, which can be a portion of the wand connector 42 provided at the first end 44 of the wand 40 or can be a separate element provided about the wand 40 specifically for providing the gripping surface, such that the collar rests or leans against a surface with the gripping properties of the gripping surface ensuring that the collar is resiliently retained against the surface and does not slide off, in order for the collar on the wand 40 to support the vacuum cleaner 10 and/or the wand 40 in the storage position, even when the hand-held portion 36 is removed or in use separately. However, it will be understood that such shapes, locations, and configurations are not limiting and that any suitable shape, location, or configuration of the gripping surface can be provided.

FIGS. 17-23B illustrate gripping assemblies 1000, 1100, 1200, 1400 that can be used to maintain the vacuum cleaner 10 in the storage position when a portion of the vacuum cleaner 10 is supported by or on a surface, rather than by being provided in a self-supporting, stand-alone upright storage position. Such gripping assemblies 1000, 1100, 1200, 1400 can be used with the vacuum cleaner 10 regardless of whether or not the vacuum cleaner 10 also includes a brake assembly. Further, the gripping assemblies 1000, 1100, 1200, 1400 disclosed herein provide support for the vacuum cleaner 10 in the storage position against a variety of surfaces, objects, and even in different configurations of the vacuum cleaner 10, such as with the hand-held portion 36 removed.

The vacuum cleaner 10 can further include other examples of support assemblies, such as an extendable retaining or support element, non-limiting examples of which include legs, tripod legs, a single leg, or a kickstand assembly, that can be used in positioning or retaining the vacuum cleaner 10 in the storage position when the vacuum cleaner 10, or at least the base assembly 34 and wand 40, is not in use. Such an assembly or element comprises at least one leg that is foldably coupled to the vacuum cleaner 10, such as to the wand 40, for movement between a folded position and an unfolded position, and can include a rubber foot at the bottom of the at least one leg for improved stability and decreased chance of sliding of the at least one leg against the floor. A retaining element, such as a collar or sleeve slidable between retaining and release positions, is provided to selectively retain the leg, which can be biased toward the unfolded position, in the folded position. The retaining element can optionally define the maximum extent or maximum angle of rotation to which the leg can unfold away from the wand 40 in the release position, and/or the retaining element can be held in the retaining position, such as by magnets or a physical stop structure.

The vacuum cleaner 10 can further include an attachment storage assembly to provide a location or system for storing the attachments along with the vacuum cleaner 10 in the storage position. Such an attachment storage assembly comprises at least one collar that is provided about the wand 40, such as by being overmolded around the wand 40. In one non-limiting example, the collar includes at least one receiving channel along its circumference for selectively receiving at least one lug extending from at least one removable attachment included with the vacuum cleaner 10 by sliding the lug downwardly into the receiving channel until the lug is resiliently seated within the receiving channel to retain the attachment to the collar. In another non-limiting example, the attachment storage assembly includes at least one loop or hook extending from the collar to serve as a holster for at least one attachment that can be slid downward into the loop so as to be retained with the wand 40 at least when the vacuum cleaner 10 is in the storage position.

The variety of features described in the present disclosure, including the brake assemblies, the gripping assemblies, the support assemblies, and the attachment storage assemblies, can be provided in any suitable combination to improve user experience with the vacuum cleaner, and in particular when providing at least a portion of the vacuum cleaner in a storage position, such as when the vacuum cleaner is not in use or when the hand-held portion of the vacuum cleaner is in use and the base assembly and the wand are left in the storage position. The brake assemblies, the gripping assemblies, and the support assemblies can all serve to ensure that the vacuum cleaner maintains its storage position and to reduce the risk of the vacuum cleaner falling over or sliding away from the storage position. Furthermore, these features provide for the vacuum cleaner to be able to achieve a stable, steady storage position in a variety of environments, such as leaning against a wall, being suspended from a table or countertop, being hooked onto a doorknob, or being provided in a self-supporting, stand-alone storage position. Any of the variety of the assemblies disclosed herein can be used independently, or in combination with at least one other assembly, to provide a vacuum cleaner that is versatile and adaptable to a user's needs.

To the extent not already described, the different features and structures of the various aspects of the present disclosure may be used in combination with each other as desired. Thus, the various features of the different aspects may be mixed and matched as desired to form new aspects, whether or not the new aspects are expressly described.

While aspects of the present disclosure have been specifically described in connection with certain specific aspects thereof, it is to be understood that this is by way of illustration and not of limitation. Reasonable variation and modification are possible within the scope of the forgoing disclosure and drawings without departing from the spirit of the present disclosure which is defined in the appended claims. Hence, specific dimensions and other physical characteristics relating to the aspects disclosed herein are not to be considered as limiting, unless the claims expressly state otherwise.

What is claimed is:

1. A surface cleaning apparatus, comprising:

a base assembly including a suction nozzle and at least one wheel;

a hand-held portion having a hand grip, a recovery container, and a suction source in fluid communication with the suction nozzle and the recovery container and configured for generating a working airstream;

a wand operably coupled between the base assembly and the hand-held portion and defining at least a portion of a working air path extending from the suction nozzle to an air outlet in the hand-held portion and including the suction source;

a swivel joint moveably coupling a lower end of the wand to the base assembly; and a brake assembly pivotally mounted to the base assembly and configured to be moveable between a first locked position wherein at least a portion of the brake assembly engages the at least one wheel and is configured to prevent rotation of the at least one wheel and wherein at least another portion engages at least one of the wand or the swivel joint to prevent the wand from lateral side-to-side movement relative to the base assembly and a second unlocked position.

2. The surface cleaning apparatus of claim 1, further comprising:

a gripping assembly moveably mounted to the hand-held portion and moveable between a first position and a second position;

wherein the first position corresponds to a use position of the surface cleaning apparatus and the second position corresponds to a storage position of the surface cleaning apparatus;

wherein at least a portion of the gripping assembly includes a gripping surface configured to engage a surface or object against which the surface cleaning apparatus is leaned;

wherein the gripping assembly is configured such that in the second position, the gripping surface contacts the surface or object to facilitate retaining the surface cleaning apparatus in the storage position; and wherein the gripping surface is at least one of:

a foam material surface;

a rubber material surface;

a textured surface;

a ribbed texture surface; or a ridged texture surface.

3. The surface cleaning apparatus of claim 2, wherein the at least a portion of the gripping assembly is configured to prevent lateral movement of the hand-held portion relative to the surface or object when the gripping assembly is in the second position.

4. The surface cleaning apparatus of claim 2, wherein the at least a portion of the gripping assembly is configured to prevent vertical movement of the hand-held portion relative to the surface or object when the gripping assembly is in the second position.

5. The surface cleaning apparatus of claim 2, wherein the gripping assembly is pivotally mounted to the hand-held portion such that the first position is a first non-rotated position and the second position is a second rotated position.

6. The surface cleaning apparatus of claim 5, wherein the gripping assembly is moved from the first, non-rotated position to the second, rotated position as the surface cleaning apparatus is leaned against the surface or object.

7. The surface cleaning apparatus of claim 2, wherein the hand-held portion further comprises a housing, the gripping assembly further comprises a body moveably mounted to the housing and wherein the gripping surface is provided on the body and configured to provide traction to the body relative to the surface or object.

8. The surface cleaning apparatus of claim 7, wherein the body has a planar portion, the gripping surface is provided on a rear side of the planar portion that faces away from the hand-held portion, and at least a portion of the gripping surface engages the surface or object when the gripping assembly is in the second position.

9. The surface cleaning apparatus of claim 8, wherein the gripping assembly is pivotally mounted to the hand-held portion about an axis of rotation.

10. The surface cleaning apparatus of claim 9, wherein the surface cleaning apparatus includes a longitudinal axis, and the axis of rotation is perpendicular to the longitudinal axis and parallel to the planar portion.

11. The surface cleaning apparatus of claim 2, wherein an additional gripping surface covers at least a bottom surface of the recovery container.

12. The surface cleaning apparatus of claim 2, wherein the gripping assembly includes a front side facing the hand-held portion and a rear side facing away from the hand-held portion; and the gripping surface is provided on the rear side.

13. The surface cleaning apparatus of claim 1, wherein the another portion of the brake assembly engages the swivel joint and is configured to prevent the lateral side-to-side movement of the wand relative to the base assembly when the brake assembly is in the first locked position.

14. The surface cleaning apparatus of claim 1, wherein the hand-held portion further comprises a housing, wherein a gripping assembly is moveably mounted to the housing, and wherein the housing forms a portion of an upright portion of the surface cleaning apparatus.

15. The surface cleaning apparatus of claim 1, wherein the at least another portion engages a front surface of the at least one of the wand or the swivel joint.

16. The surface cleaning apparatus of claim 1, further comprising:

a gripping assembly moveably mounted to the hand-held portion at a location opposite from a portion of a handle of the hand-held portion, and wherein the gripping assembly is moveable between a first position and a second position;

wherein at least a portion of the gripping assembly includes a gripping surface configured to provide traction against a surface or object against which the surface cleaning apparatus is leaned;

wherein the first position corresponds to a use position of the surface cleaning apparatus and the second position corresponds to a storage position of the surface cleaning apparatus; and wherein the gripping assembly is configured such that in the second position, the gripping surface contacts the surface or object to facilitate retaining the surface cleaning apparatus in the storage position.

17. The surface cleaning apparatus of claim 16, wherein the gripping assembly includes a front side facing the hand-held portion and a rear side facing away from the hand-held portion; and the gripping surface is provided on the rear side.

* * * * *